US009046083B1

(12) United States Patent
Gamble et al.

(10) Patent No.: US 9,046,083 B1
(45) **Date of Patent: *Jun. 2, 2015**

(54) RECIPROCATING DEVICE WITH DUAL CHAMBERED CYLINDERS

(76) Inventors: Christopher L. Gamble, Canoga Park, CA (US); Richard A. Bordonaro, Simi Valley, CA (US)

( * ) Notice: Subject to any disclaimer, the term of this patent is extended or adjusted under 35 U.S.C. 154(b) by 173 days.

This patent is subject to a terminal disclaimer.

(21) Appl. No.: 13/336,438

(22) Filed: Dec. 23, 2011

Related U.S. Application Data

(60) Continuation of application No. 12/381,628, filed on Mar. 12, 2009, now Pat. No. 8,109,737, which is a division of application No. 11/371,875, filed on Mar. 7, 2006, now Pat. No. 7,503,291.

(60) Provisional application No. 60/660,244, filed on Mar. 9, 2005.

(51) Int. Cl.
*F04B 1/02* (2006.01)
*F04B 39/12* (2006.01)

(52) U.S. Cl.
CPC ..... *F04B 1/02* (2013.01); *F04B 39/128* (2013.01)

(58) Field of Classification Search
CPC ..... F04B 1/02; F04B 23/06; F04B 27/02; F04B 27/005; F04B 39/12; F04B 39/125; F04B 39/126; F04B 39/14; F04B 39/0094; F04B 53/007; F04B 53/16; F04B 53/162; F04B 39/128
USPC ..... 417/415, 521, 569, 571; 137/315.33
See application file for complete search history.

(56) References Cited

U.S. PATENT DOCUMENTS

| | | | | | |
|---|---|---|---|---|---|
| 3,478,956 | A * | 11/1969 | Gosha | 417/534 |
| 3,818,808 | A * | 6/1974 | Shafer | 92/138 |
| 3,990,816 | A * | 11/1976 | Kohler et al. | 417/536 |
| 4,013,048 | A * | 3/1977 | Reitz | 123/55.7 |
| 4,190,402 | A * | 2/1980 | Meece et al. | 417/415 |
| 4,442,758 | A * | 4/1984 | Groll | 92/138 |
| 4,598,672 | A * | 7/1986 | Jayne et al. | 123/197.4 |
| 4,756,674 | A * | 7/1988 | Miller | 417/534 |
| 4,931,000 | A * | 6/1990 | Fleming, Jr. | 417/534 |
| 5,092,185 | A * | 3/1992 | Zornes et al. | 74/50 |
| 5,131,353 | A * | 7/1992 | Bauer et al. | 123/55.5 |
| 5,417,309 | A * | 5/1995 | Brackett | 184/6.5 |
| 5,944,493 | A * | 8/1999 | Albertin et al. | 417/273 |
| 6,478,047 | B1 * | 11/2002 | Powell | 137/512 |
| 8,109,737 | B1 * | 2/2012 | Gamble et al. | 417/397 |
| 2003/0180159 | A1 * | 9/2003 | Blessing et al. | 417/273 |

* cited by examiner

*Primary Examiner* — Bryan Lettman
*Assistant Examiner* — Charles W Nichols
(74) *Attorney, Agent, or Firm* — Kelly & Kelley, LLP

(57) ABSTRACT

A reciprocating device which may be operated either as a compressor or an engine. Each cylinder has a reciprocating piston connected to a piston rod. Dual cylinder chambers are located in each cylinder on opposite sides of the piston. The pistons are connected to a scotch yoke which translates the reciprocating motion of the pistons to rotary motion at a shaft in the engine mode. In the compressor mode, the shaft is connected to a power source. The engine components such as the pistons, rods, bushings and cylinder lines may be high quality steel or a ceramic.

9 Claims, 43 Drawing Sheets

Firing Order Four Cylinder Engine

All Four Cylinders Fire in Two Full Rotations Of Crankshaft

Cylinder 1 Fires

180 Degree Rotation Cylinder 2 Fires

180 Degree Rotation Cylinder 3 Fires

180 Degree Rotation Cylinder 4 Fires

RECIPROCATING DEVICE WITH DUAL CHAMBERED CYLINDERS

CROSS-REFERENCE TO RELATED APPLICATIONS

This is a continuation of U.S. application Ser. No. 12/381,628 filed Mar. 12, 2009, which is a divisional application of U.S. patent application Ser. No. 11/371,875, filed Mar. 7, 2006, now U.S. Pat. No. 7,503,291, issued Mar. 17, 2009, entitled "Reciprocating Device With Dual Chambered Cylinders" based on U.S. Provisional Application Ser. No. 60/660,244, filed Mar. 9, 2005, of the same title, the contents of which are incorporated by reference herein.

TECHNICAL FIELD

The present invention relates to a reciprocating device having a scotch yoke rectilinear rotary motion translation system utilizing dual chambered cylinders. The device may be operated as an engine or a compressor. As an engine, the device operates as a four cycle compression ignition device and is compatible with various fuels such as gasoline, diesel, natural gas and propane. The device is highly efficient, compact and is of a design which facilitates manufacture and addition of cylinders as required. When operating as an engine, the reciprocating piston device provides high efficiency, high horsepower to weight ratios and reduced emissions. The compressor embodiment operates at high efficiency and volumetric capacity for its size.

BACKGROUND

Various types of engine designs have been developed over the years. The most common engine is the conventional reciprocating piston internal combustion engine (IC engine) in which a reciprocating piston is coupled by a connecting rod to the offset crank pins of a crankshaft. The reciprocating motion of the pistons is translated to rotary motion at the crank shaft. Power is delivered by the crank shaft to the driven device such as a vehicle or in stationary application to a pump or other device.

A wide variety of alternate engine designs have been developed over the years in attempts to improve upon the basic engine design described above. These devices may change the cycle dynamics of the engine. One example is the Wankel engine which was originally developed in Germany and has been utilized in various operating environments including automobiles such as the Mazda.

Another prior design employ a scotch yoke. While scotch yoke designs provide a means of converting the reciprocating linear piston motion to rotary motion, practical problems have developed including vibration, excessive frictional losses and excessive wear.

As an example, U.S. Pat. No. 5,375,566 shows an internal combustion engine utilizing a scotch yoke type motion translator which claims improved cycle dynamics. The engine is horizontally opposed with each shuttle having a pair of pistons attached at the ends of a pair oppositely extending arms. A centrally located aperture in the shuttle accommodates the crank pin and incorporates a pair of rack blocks bolted to the shuttle. The cycle dynamics of the engine may be matched to the to the thermo dynamics of a selected power cycle and fuel by adjusting the shape of the sectors and racks.

The present invention relates to a new and novel reciprocating device which may be operated either as a combustion engine or as a compressor. As an engine, the device is highly efficient having a high power-to-weight ratio, reduced cylinder friction, reduced vibration, reduced pollution. Lubrication requirements are also minimized.

The engine design of the invention is extremely versatile and compact and allows for convenient increase in size and horsepower by addition of additional cylinders by addition of basic components with major modifications. The design utilizes fewer components than conventional IC engine designs and each cylinder has a piston with cylinder chambers disposed on opposite sides of the piston so the engine essentially "fires" every half stroke.

SUMMARY

Briefly, the present invention provides a reciprocating device having a crank case housing on which are mounted at least two cylinder housings. The cylinder housings may be opposed or may be adjacent one another. Each cylinder housing has a reciprocating piston connected to a piston rod with cylinder chambers located on opposite sides of the piston. In the engine mode of operation, an ignition device, such as a sparkplug, is associated with each of the opposed cylinder chambers. Fuel delivery may be by injection or carbuerization.

All the cylinder housing assemblies are similarly constructed having an internal chamber which reciprocably receives a piston and defines dual chambers at opposite sides of the piston within the cylinder. The pistons are connected to a scotch yoke by a connecting rod. The yoke translates the reciprocating motion of the pistons to rotary motion at an output or drive shaft.

The cylinder chambers are ported to exhaust and intake and communication is controlled by valving which may be conventional lifter-style valves or may be rotary style valves. In the compressor embodiment, valving responds to differential pressure to open or close communication with intake and exhaust ports. A crankshaft is attached to a flywheel which has a bearing surface received within a slot in the yoke. Reciprocation of the piston rods will reciprocate the yoke causing the flywheel and crankshaft to rotate. A timing chain or belt is driven by a power takeoff from the drive shaft which timing chain or belt will operate cams which control the lifter valve operations or control the rotation of rotary valve members.

When connected to a source of power, the basic engine design with minor modification may operate as a compressor. The engine components such as the pistons, rods, bushings and cylinder liners may be a high quality steel or may be ceramic.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

Figure 1:
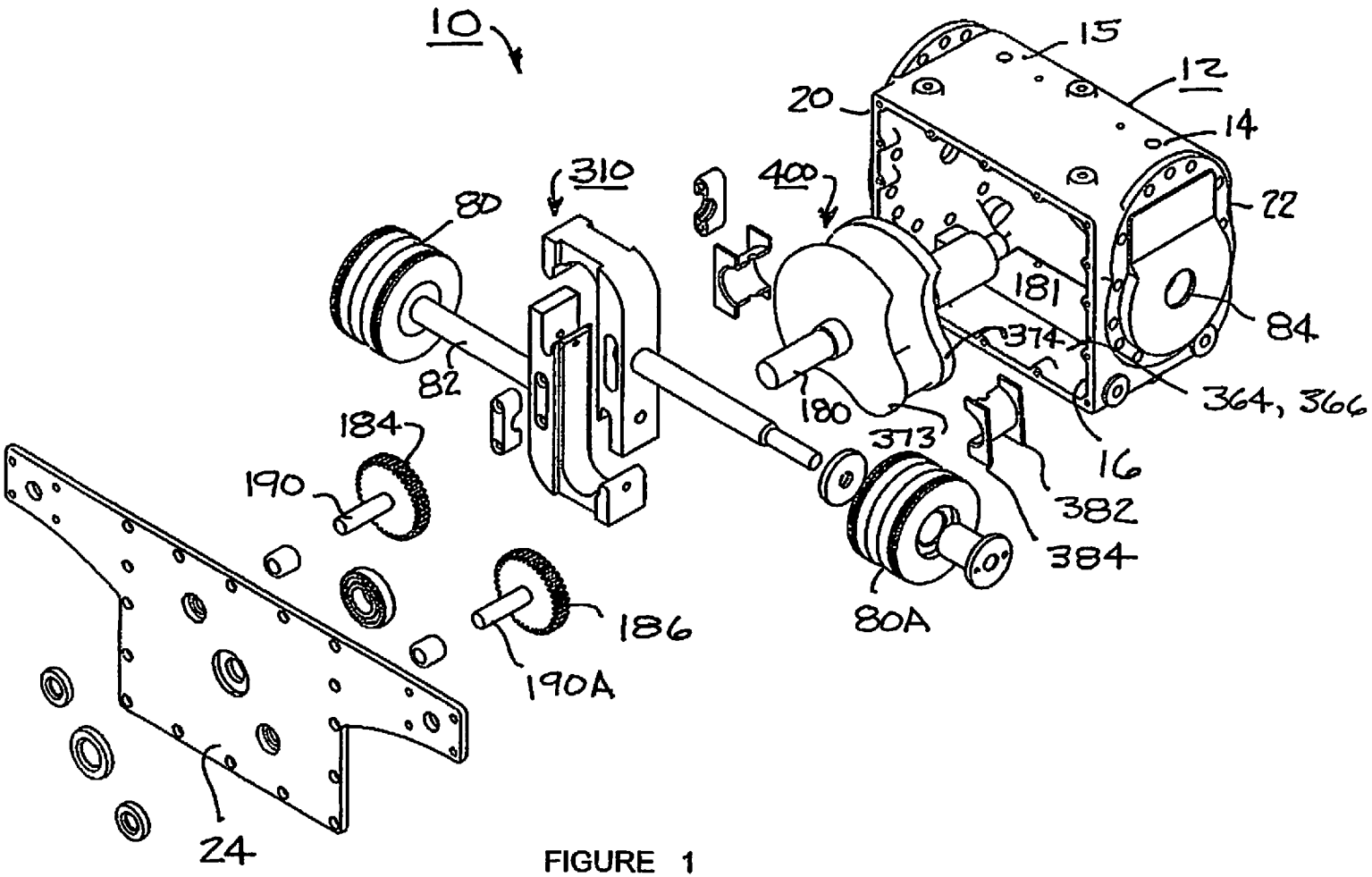
FIG. 1 is an exploded view of a portion of the engine of the present invention showing the crankcase and the pistons and yoke.
Figure 1A:
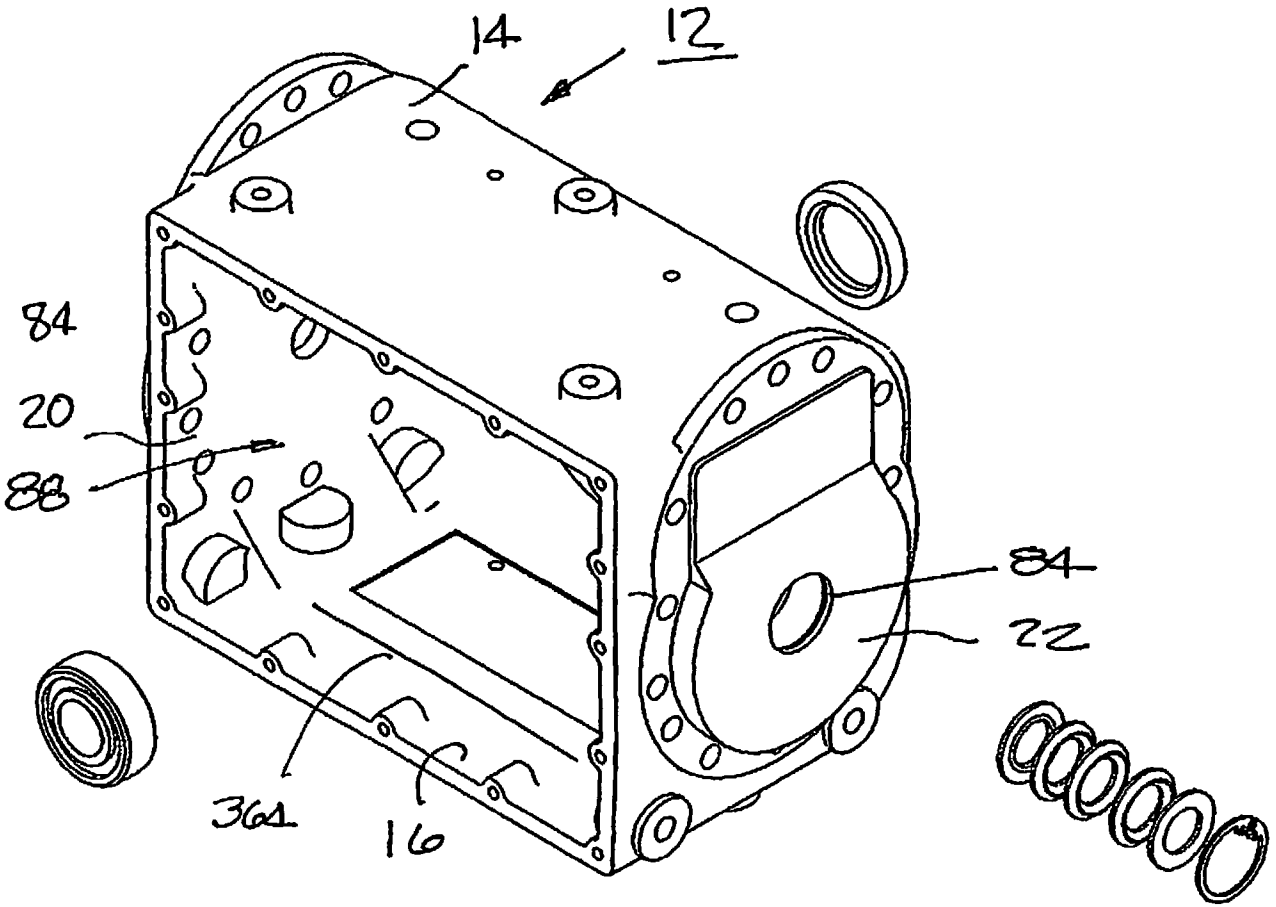
FIG. 1A is a perspective view of the crankcase housing.
Figure 1B:
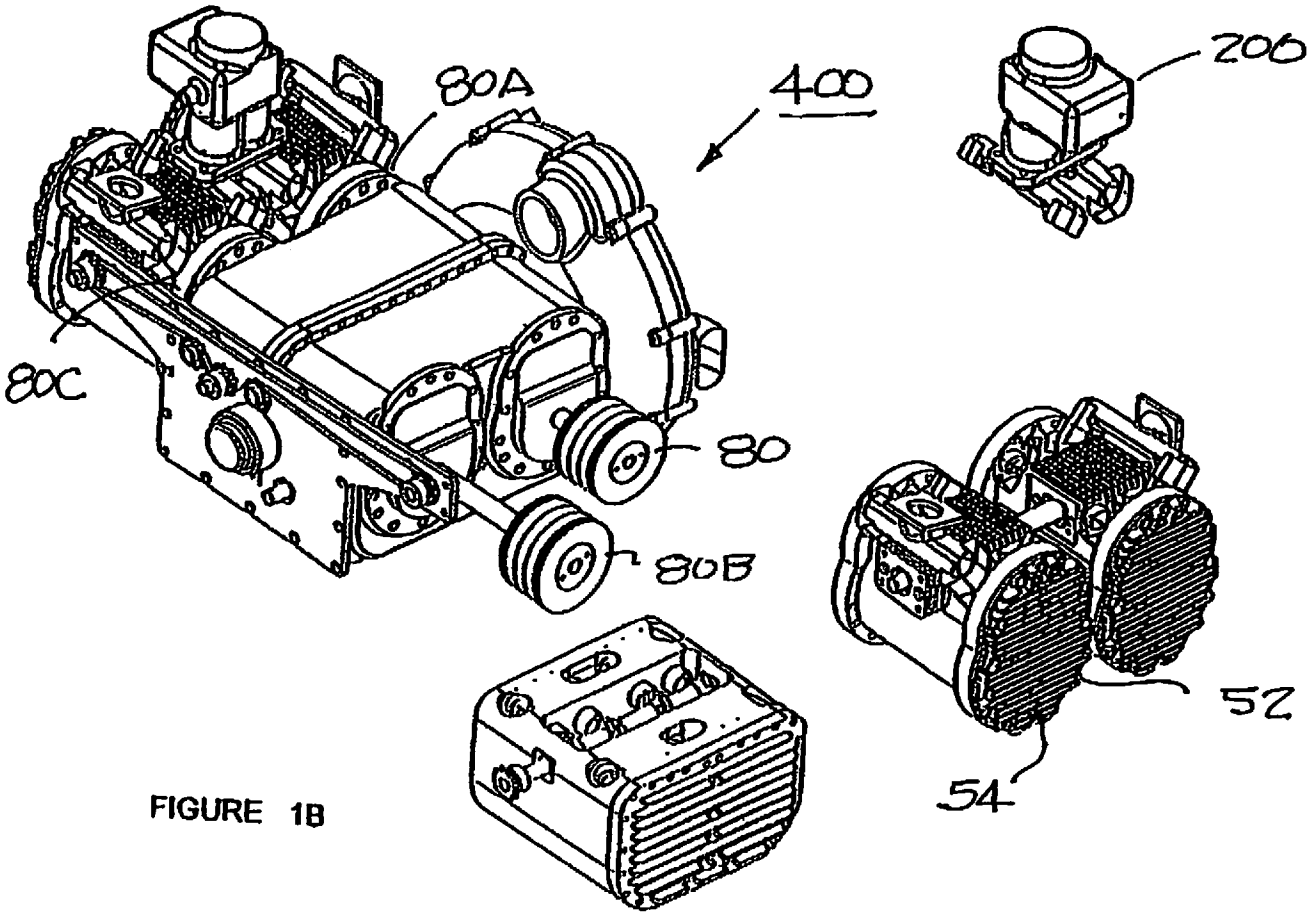
FIGS. 1B and 1C show multiple opposed cylinder arrangements.
Figure 1C:
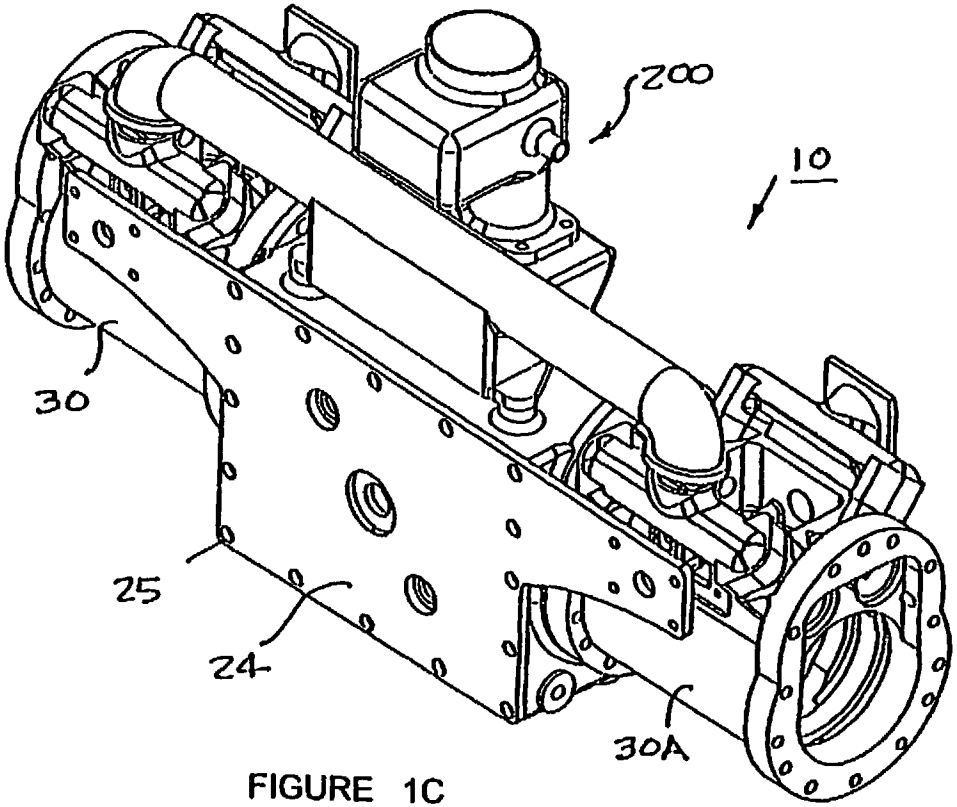

Turning now to FIGS. 1, 1A and 1C which show one embodiment of the reciprocating device of the present invention. This embodiment is generally designated by the numeral 10 is shown as an internal combustion engine having opposed cylinder assemblies 30, 30A, each cylinder assembly housing a piston 80, 80A. Dual cylinder chambers 50, 50A are defined in each cylinder chamber on opposite sides of the pistons as will be explained.

The engine 10 has a crankcase 12 having a housing 14 of a suitable material such as aluminum. The crankcase has upper wall 15, lower wall 16, rear wall 18 and opposite sidewalls 20, 22. A crankcase cover plate 24 is securable to the open side of the crankcase by suitable bolts 25 and, as customary, suitable sealing gasket, not shown, is interposed between the cover plate 24 and the crankcase 12. The crankcase may be provided with removable plugs 29 for adding and draining lubricant as necessary.

Figure 4:
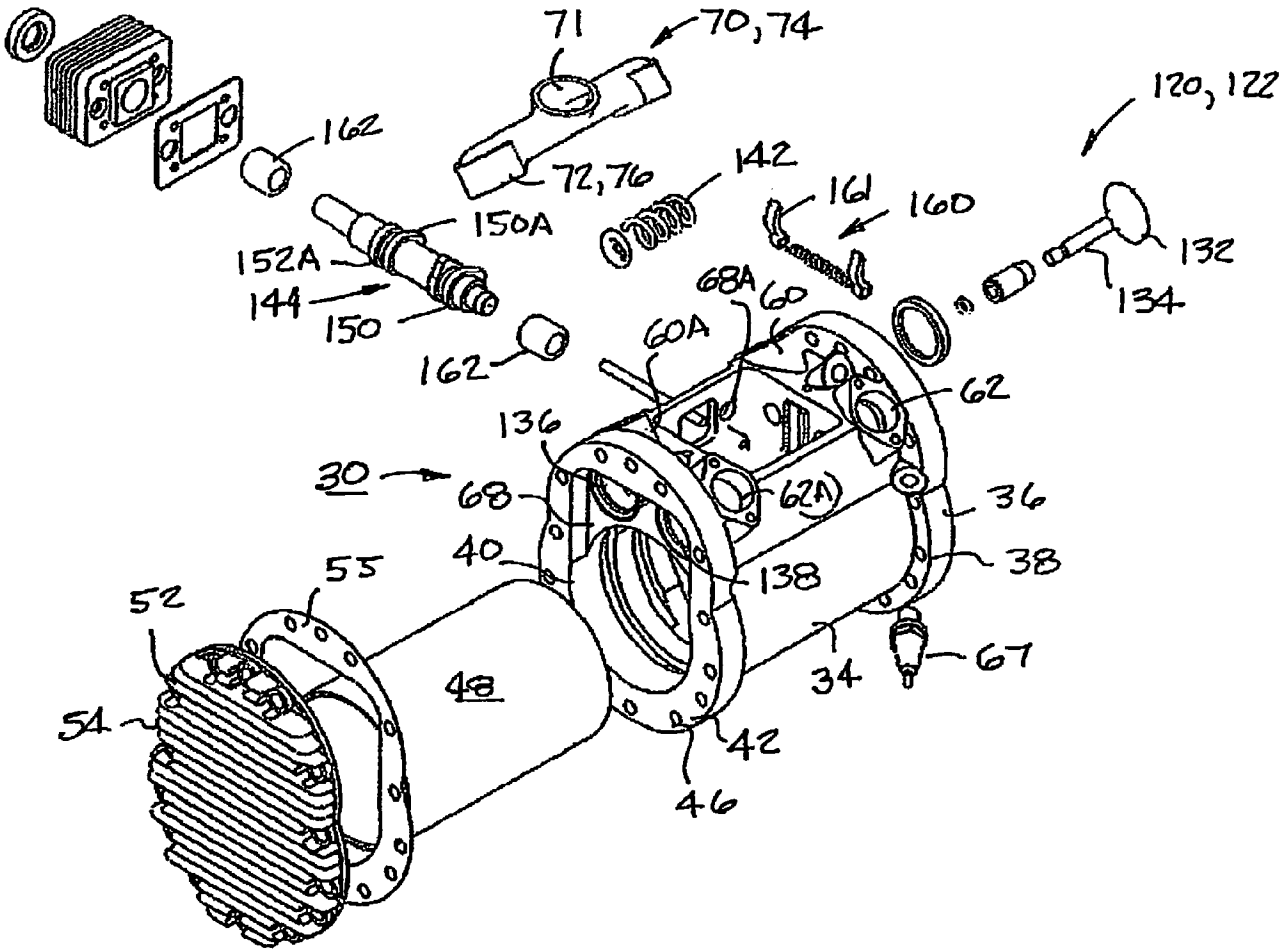
FIG. 4 is an exploded view of a representative cylinder assembly.

Cylinder assemblies 30, 30A extend oppositely from the crankcase at sidewalls 20, 22. Referring to FIG. 4, an exploded view of cylinder assembly 30 is shown, it being understood that cylinder assembly 30A is identical in construction. Cylinder assembly 30 has a body or housing 34 which has a flange 36 at its inner end which defines a plurality of bores 38 arranged on a bolt circle. The bores 38 are positioned to align with corresponding bores in sidewall 20 so the cylinder assembly can be secured to the crankcase by suitable bolts and a sealing gasket.

Figure 2:
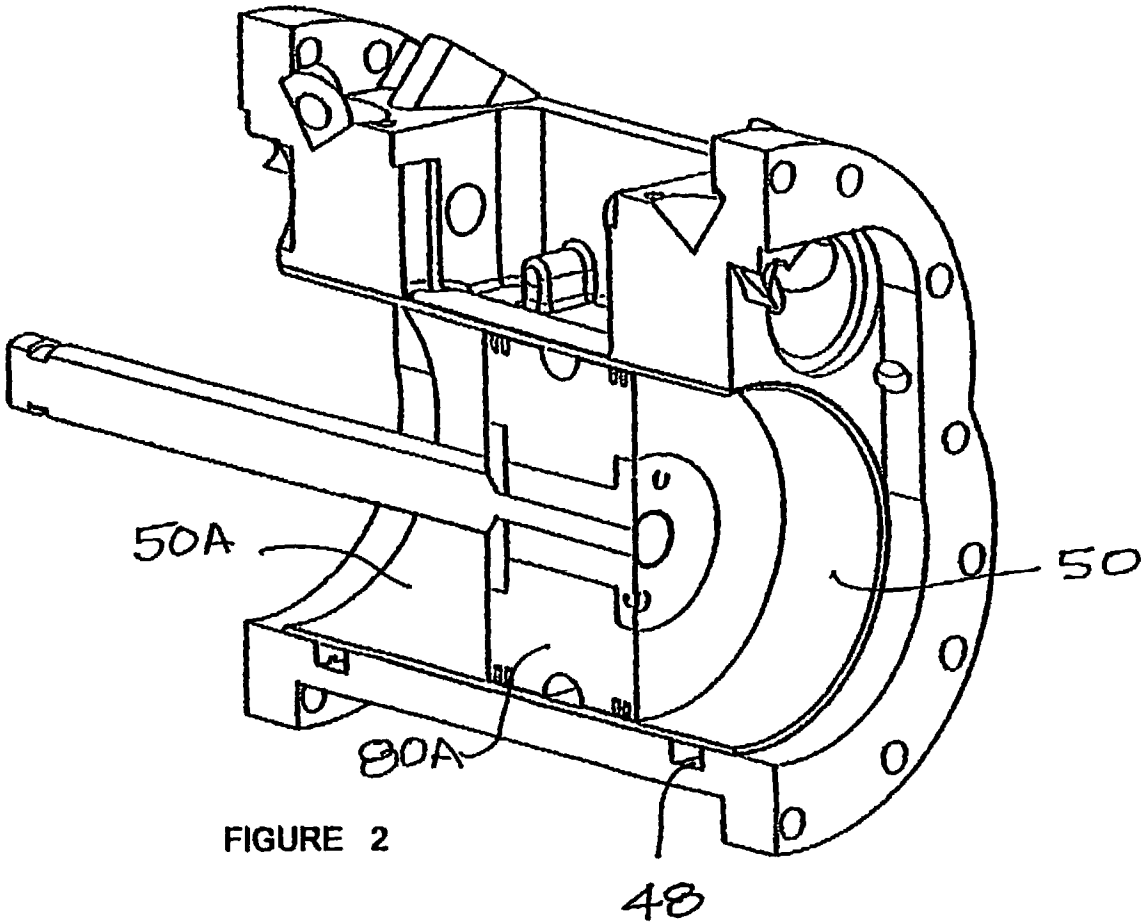
FIG. 2 is a cross-sectional view of a cylinder and piston.

The cylinder housing 34 defines a cylindrical cylinder bore 40, as seen in FIG. 2. The outer end of the cylinder housing is provided with a flange 42 which also has a plurality of bores 46. A cylinder sleeve 48 is received in the cylinder bore. The sleeve defines a cylinder chamber 50. The cylinder sleeve 48 may be of a suitable material, for example if the cylinder housing is aluminum, the cylinder sleeve may be steel or may be a high density ceramic such as silica nitrite as it is preferred the materials of the sleeve and cylinder housing be dissimilar. A cylinder head 52 having heat dissipating fins 54 is secured to the flange 42 by suitable bolts. A cylinder head gasket 55 is interposed between the cylinder head and the flange 42. Additional cooling may be provided by water jackets 58 in the housing through which a coolant is pumped which circulates around the sleeve 48, as seen in FIG. 2.

Referring to FIG. 4, intake ports 60 and 60A communicate with the cylinder chamber 50 through the cylinder sleeve at opposite ends of the housing. Similarly, exhaust ports 62, 62A which are positioned oppositely and spaced from the inlet ports also communicate with the chamber 50 in the cylinder sleeve. Threaded bores 66, 66A are provided for installation of ignition devices such as spark plugs 67 and extend into the cylinder bore near each end.

The intake and outlet ports are each formed in walls 68 and 68A at opposite ends of the cylinder housing 34. The intake ports 60, 60A receive an intake manifold 70 which has flanges 72 which are securable to the flanges about the inlet ports. Similarly, an exhaust manifold 74 is provided with flanges 76 which are securable to the flanges about the exhaust ports. The inlet and exhaust manifolds each have central ports 71 which selectively communicate with the cylinders across valving as will be explained and are connectable to fuel delivery and exhaust systems.

Figure 8:
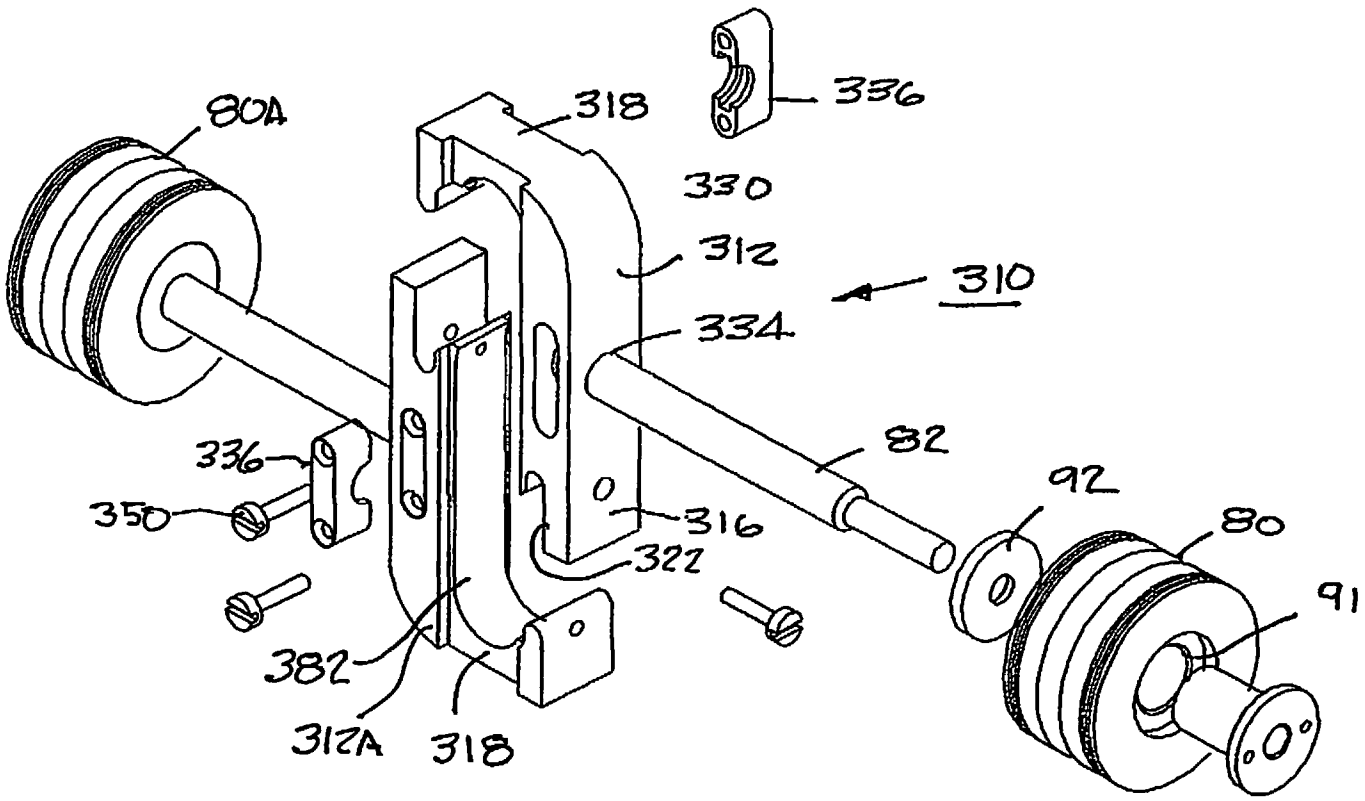
FIG. 8 is an exploded view of the yoke, rod and cylinders.
Figure 9:
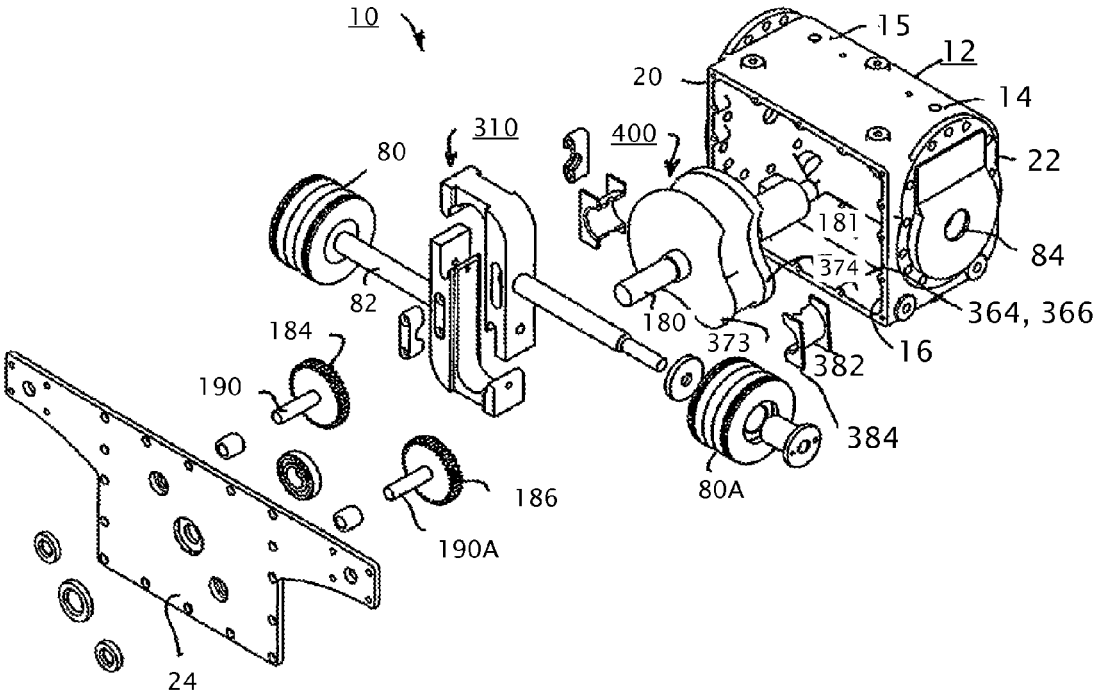
FIG. 9 is an exploded view of a piston rod assembly.
Figure 9A:
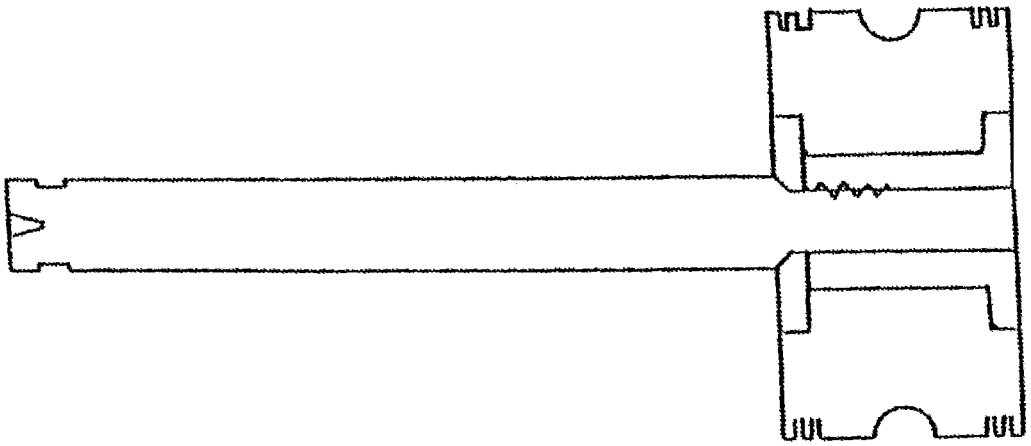
FIG. 9A is a cross-sectional view taken along 9A-9A of FIG. 9 showing components assembled.
Figure 10:
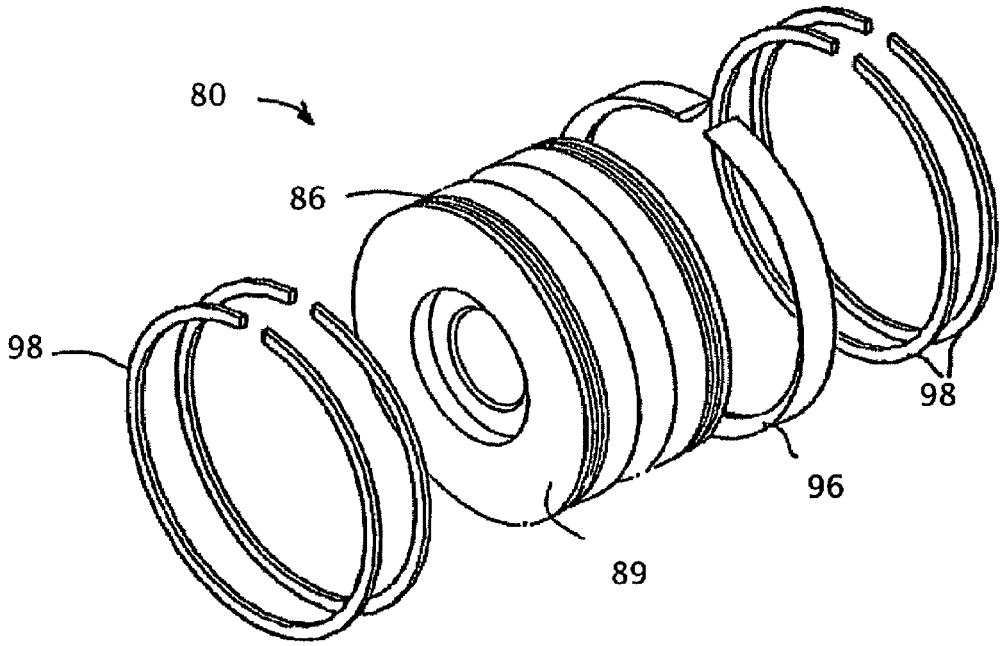
FIG. 10 is an exploded detail view of a piston and rings.

Each of the cylinder chambers houses reciprocable pistons 80, 80A as seen in FIGS. 1, 8 and 10. The piston 80, a description of which also applies to piston 80A, is carried on a piston rod 82 which is linear and extends through a sealed opening 84 in the crankcase end wall 20 into the crankcase chamber 88 and connects to the yoke assembly 310 as will be discussed, with reference to FIG. 3B. Referring to FIGS. 9 and 10, each piston has a generally cylindrical outer wall 86 and opposite end walls 89 and in the assembled engine configuration a first cylinder chamber 50 is defined between one piston end wall and the crankcase end wall. A second chamber 50A is defined at the opposite side of the piston at the head end of the cylinders. Appropriate piston rings or seals 98 extend about the periphery of the pistons engaging the bore in the sleeve. An annular stop ring or collar 94 is provided on the end of the piston rod 82. The rod extends through a bore 91 in the piston. A stop ring 92 is positioned inward of the end of the rod 82 and abut the face of the piston. The end of rod 82 is threaded at 104 to receive the stop collar 94. The flange 108 abuts the piston 80. A material such as Locktite® is applied to the threads 104 to secure the assembly.

Referring again to FIG. 10, an annular groove 95 extends around the body of each of the pistons and receives a lubrication ring 96. Compression rings 98 extend adjacent the lube ring. The lubrication ring 96 may be a synthetic lubricant which is a relatively hard and soap-like material and is temperature responsive in the range of 300° to 350° F. The lubrication ring will provide lubrication as the piston reciprocates. One or more compression rings 98 are provided extending annularly around the piston on either side of the lubricant ring.

The piston 80 may be a synthetic material. Ceramic materials such as silicon nitrite and alumina silicate have been found to work well with minimal wear. Synthetic materials operate at high temperatures with little contraction and expansion. In compressor, rather than engine applications, the pistons may be plastic or metal and glass-filled for reduced weight.

Sleeve 48 is inserted in the cylinder as seen in FIG. 4. Preferably the compression rings 98 and the sleeve 48 are formed of different materials to minimize wear. For example, if the compression rings 98 are steel, the sleeve 48 is preferably a material such as cast iron. The use of different materials for these components minimizes wear, eliminating or substantially reducing the need for lubrication. Alternatively, the compression rings 98 may be cast iron and the cylindrical sleeve 48 which defines a cylindrical chamber 50 in which the piston reciprocates preferably is steel.

As has been described above, in the engine configuration, each cylinder assembly and enclosed piston defines two opposed or dual chambers 50, 50A. Admission of air/fuel mixture into the chambers and exhaust of combustion products are controlled by intake and exhaust valves 120 and 122, respectively, as seen in FIG. 4. Each of the chambers 50, 50A is ported having an intake Valve 120 and exhaust valve 122 of the poppet type having a conical surface 132 which seats in the associated bores 136, 138 controlling communication with the intake or exhaust manifold through the associated intake or exhaust port. Each valve has a valve stem 134 which extends into the valving chamber 140 which is located at a central location on the cylinder body. The valves are normally spring-biased by a valve spring 142 to a closed position and cyclically open and close by a rotating cam 144 having projecting lobes 150, 150A, 152, 152A. Lobes 150A, 152A are associated with the intake valves for the inboard cylinder chamber. Lobes 150, 150A operate to open and close the exhaust valve associated with the outboard cylinder chamber.

The cam lobes operating through the valve lifters 160 will cause the valves to open to admit air fuel mixture and exhaust products of combustion. The surface 161 of valve lifters may be arcuate, V-shaped, or other shape, depending on the desired valving timing operation. The cycle of operation will be explained below. The cams 144 are received in cam bearings 162 in the sidewall of the upper valve chamber 140. The outer end of each of the cams carries a suitable gear 166 which is engaged by a timing chain or timing belt 170 which is driven by a power takeoff 165 from the crankshaft.

Figure 3:
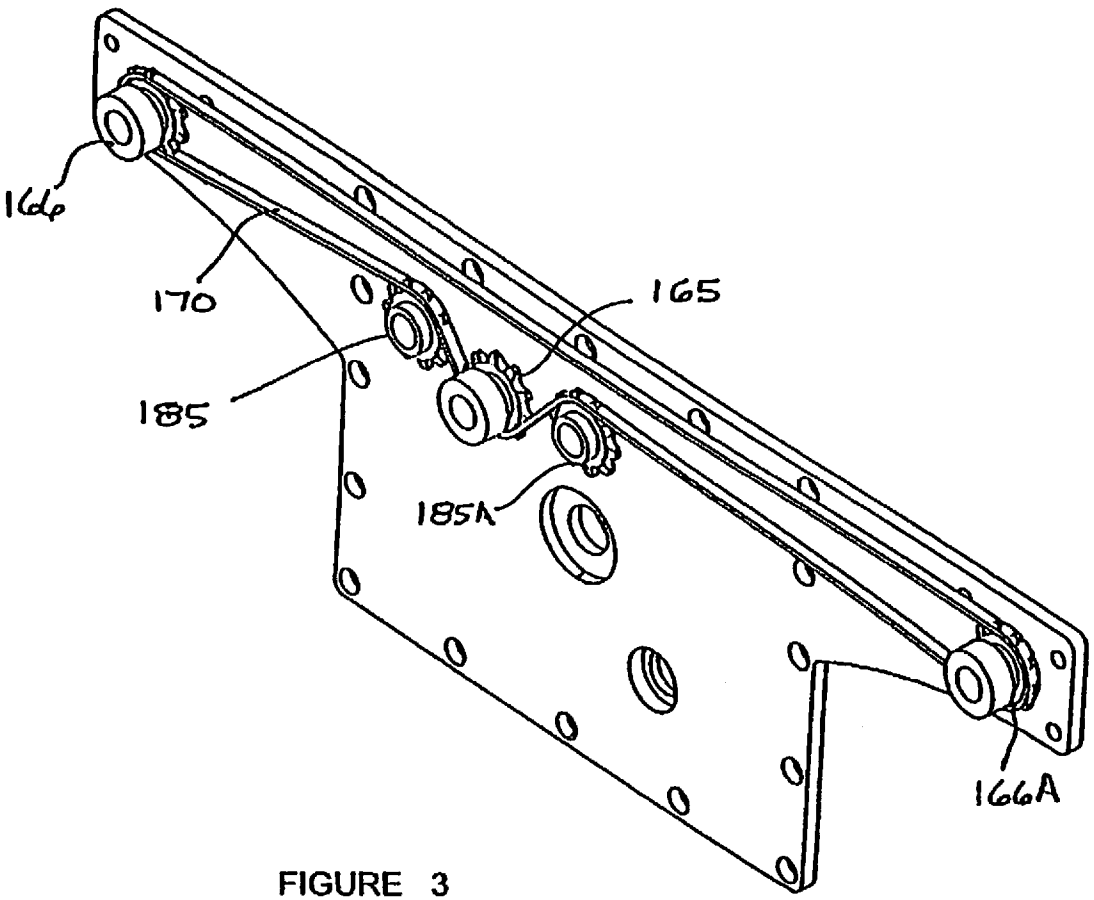
FIG. 3 is a perspective view of the crankcase timing belt cover with a drive for the valves.
Figure 3A:
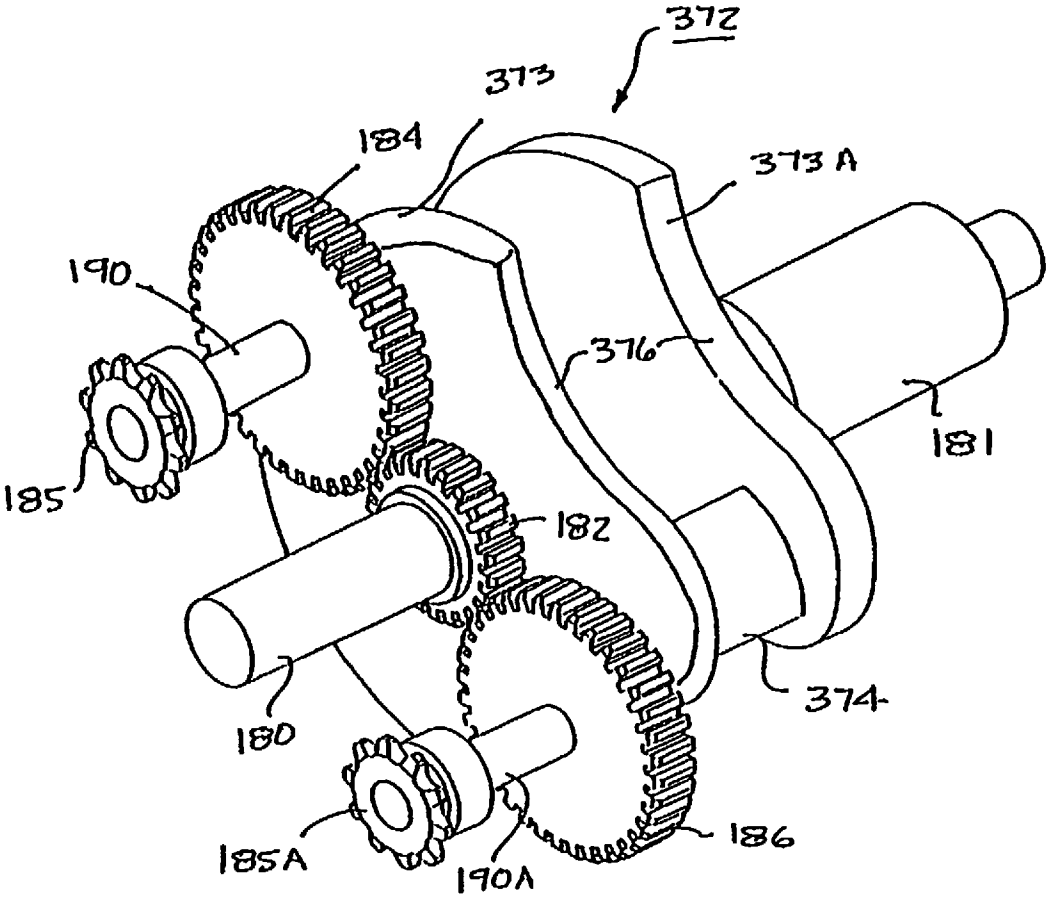
FIG. 3A is a perspective view of the yoke, cam and power takeoff.

FIGS. 1, 3 and 3A illustrate the drive arrangement for the cams 144 which operate the valve lifters 160. It will be seen that the output shaft 180 may be provided with a gear 182 which, in turn, engages adjacent gears 184, 186 each of which carry a shaft 190, 190A which extends through the crank case cover 24. A gear ratio of typically 2 to 1 exists between the output shaft and the cam drive gears. The ends of the cam drive gears each carry a gear 185, 185A. A timing chain 170 extends around each of the gears 185, 185A and the cam gears to rotate the cam gears 166, 166A associated with each of the opposed cylinders to operate the intake and exhaust valving. If a timing belt is used, pulleys are used instead of gears.

Fuel may be supplied to the intake manifold by various devices such as a carburetor device 200 connected to the manifold or alternately fuel may be delivered by fuel injectors associated with the cylinder chambers. Fuel is supplied from a fuel tank and delivered under pressure of a fuel pump, not shown, as these components are conventional. Similarly, the exhaust manifold may be connected to an exhaust system having a muffler and catalytic converter as necessary to meet environmental standards.

One significant advantage of the engine of the present invention is that the valve housing 140, which contains the valve operating mechanisms such as the cams and lifters associated with each cylinder, is positioned on the cylinder housings at intermediate locations mounted on the exterior of the cylinder walls. In this way, the various components such as the lifters, valves, cams and the intake and exhaust manifolds are in a compact position immediately adjacent the cylinders which greatly simplifies the design making it more compact, minimizing parts and increasing the efficiency of operation.

Figure 4A:
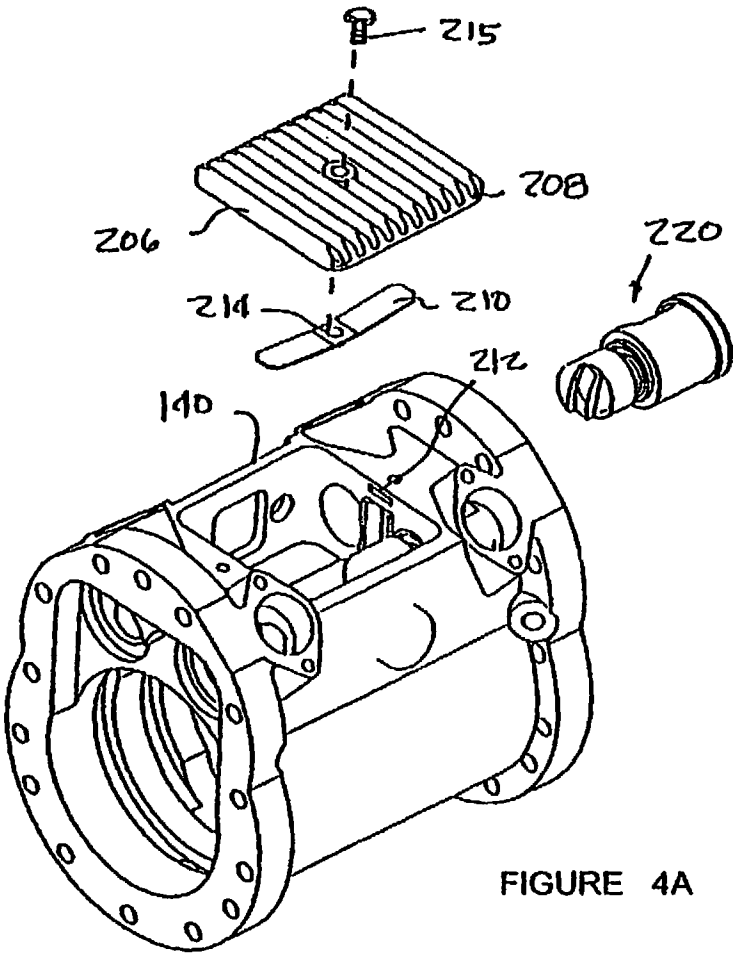
FIG. 4A shows an alternate cylinder assembly.
Figure 5:
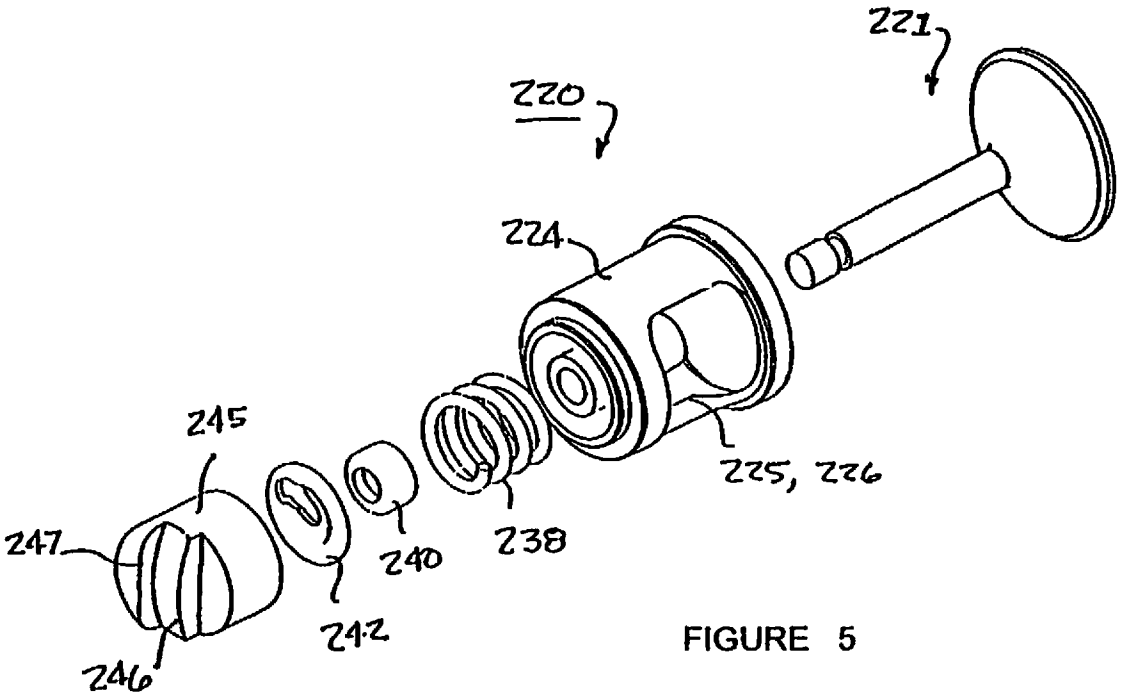
FIG. 5 is a perspective view of a valve assembly.

FIG. 4A shows an alternate cylinder and valve housing assembly with a valve cover 206 in which the valve cover has chamfered peripheral surfaces 208. The interior of the valve chamber 140 defines spaced-apart slots 212 at the interior of the opposite end walls. The ends of valve cover lock 210 of spring steel or other resilient material are inserted into the slots 212 and, due to its resiliency, will axially extend engaging the slots. A threaded bore 214 is provided at an intermediate location on the valve cover lock which receives a fastener 215 which will extend through the valve cover into the lock securing the cover on the valve chamber.

Figure 6:
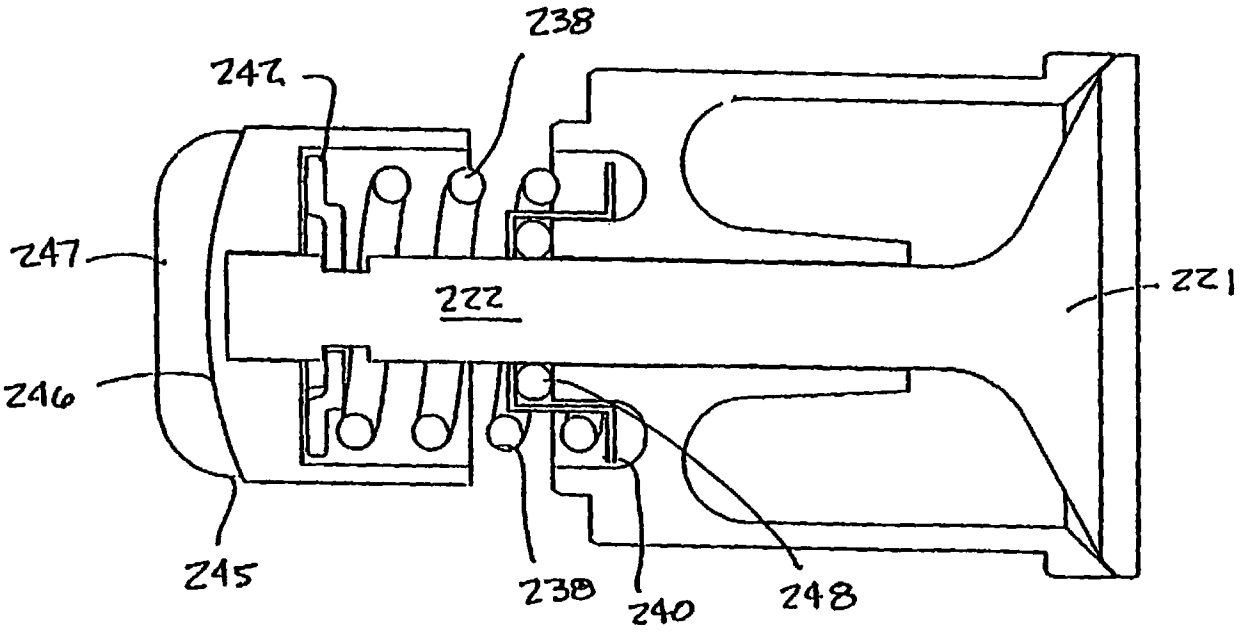
FIG. 6 is a cross-sectional view of the valve assembly of FIG. 5.

Referring to FIGS. 4A, 5, 6 and 7, individual valve assemblies 220 are shown which are modular. The valve assemblies 220 each has a valve 221 having a stem 222 extending through a cylindrical valve port body 224 having openings 225, 226 on either side to define inlet and outlet passages. The edges of the valve 221 seat on the port body, as seen in FIG. 6. A valve spring 238 is provided at the bottom end of the valve port body and abuts a valve seal cap 240 and a flat spring washer-like keeper 242. A valve lifter cap 245 is secured to the end of the valve stem and defines a cam contact surface 246 which is engaged by a selected one of the cam lobes 150, 150A shown in FIG. 4. An upwardly extending stop 247 engages a surface in the housing to prevent the lifter from turning, as seen in FIG. 6.

Figure 7:
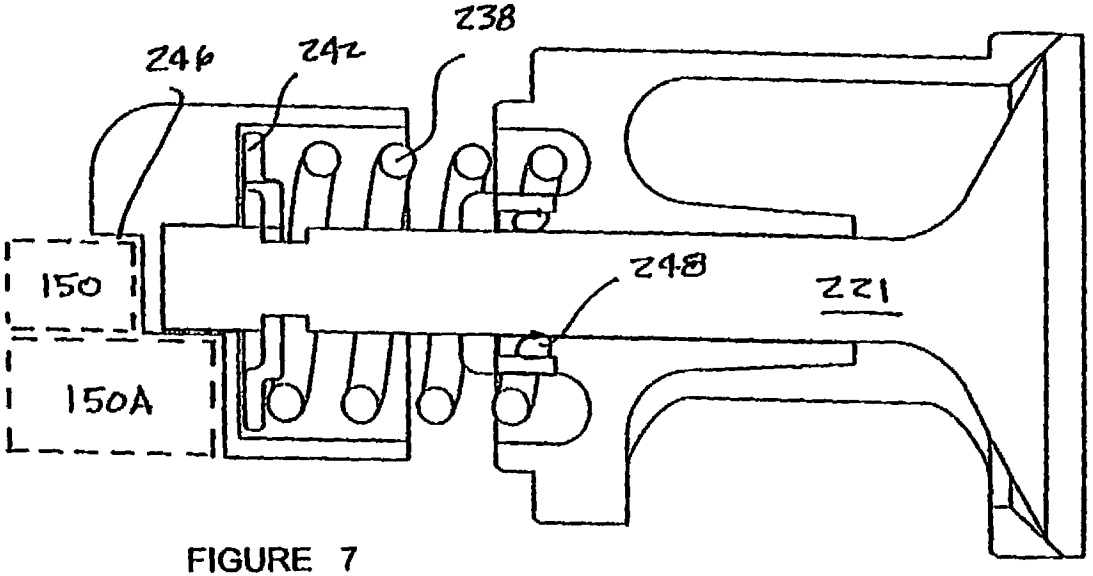
FIG. 7 is a cross-sectional view similar to FIG. 6 which has been rotated 90°.

An O-ring 248 extends around the valve stem within the seal cap. The valve spring applies a biasing force to maintain the valve lifter cap in engagement with the cam lobe. A spring keeper 242 is received within an annular groove in the end of the valve stem. It will be seen the valve cap is conFIG.d having a clearance area for the cam lobe and an adjacent, arcuate contact surface, as seen in FIG. 7

Figure 21:
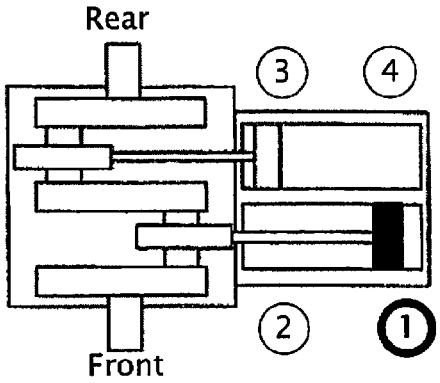
FIG. 21 is a schematic illustration showing the operational sequence of a 4 cylinder engine according to the present invention.
Figure 21:
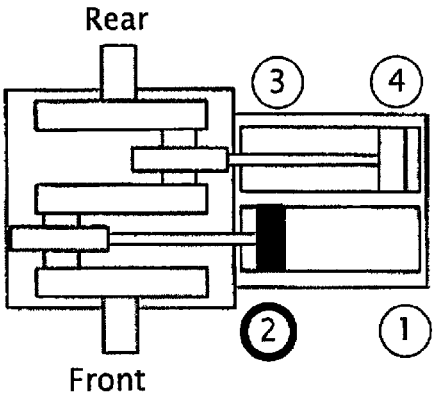
Figure 21:
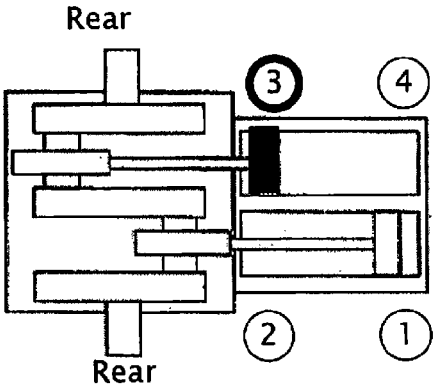
Figure 21:
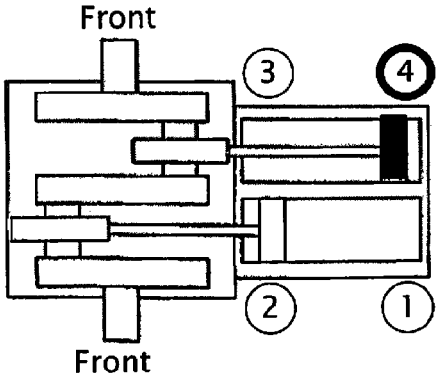
Figure 22:
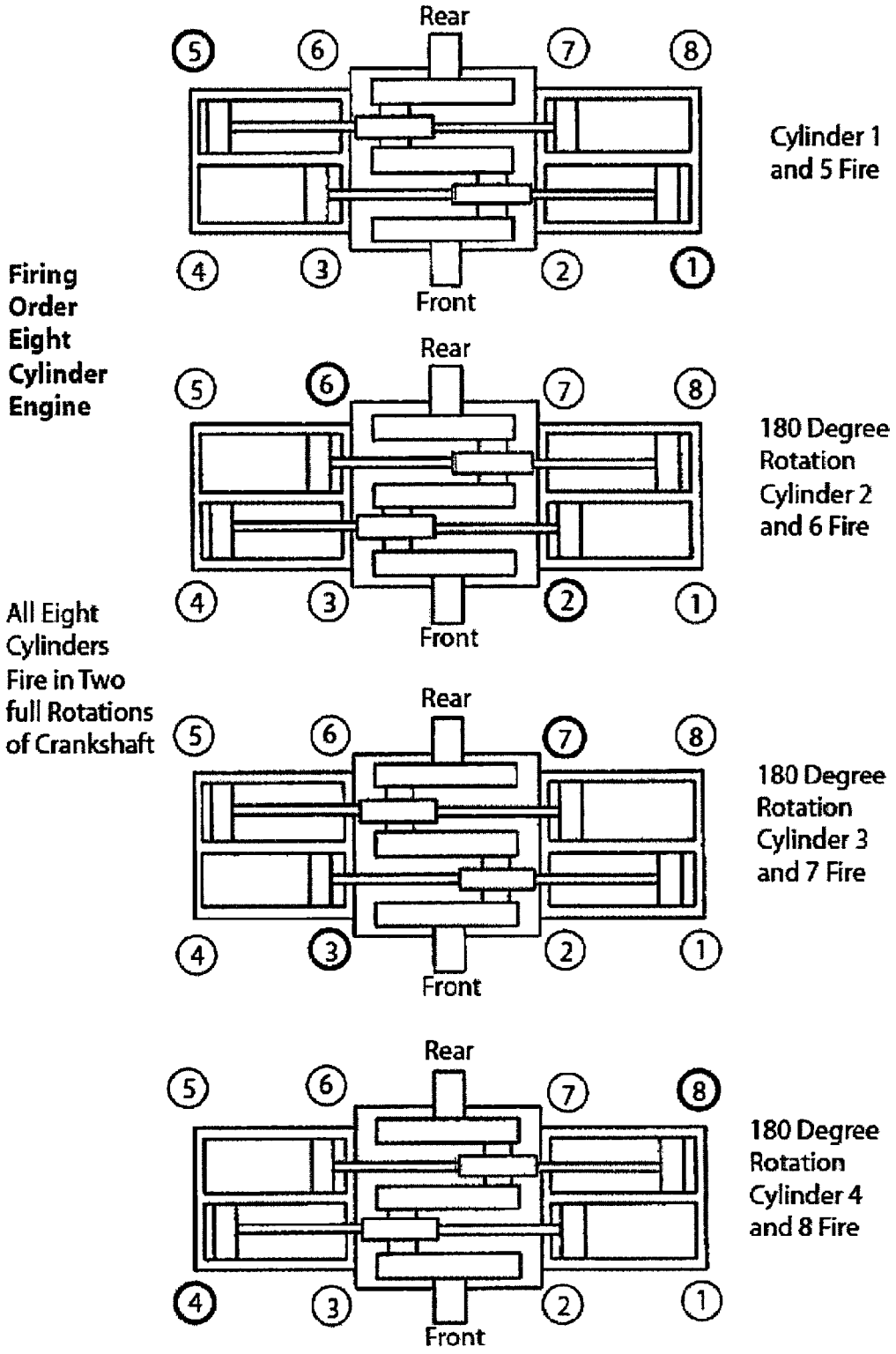
FIG. 22 illustrates the operational sequence of an 8 cylinder engine.
Figure 23:
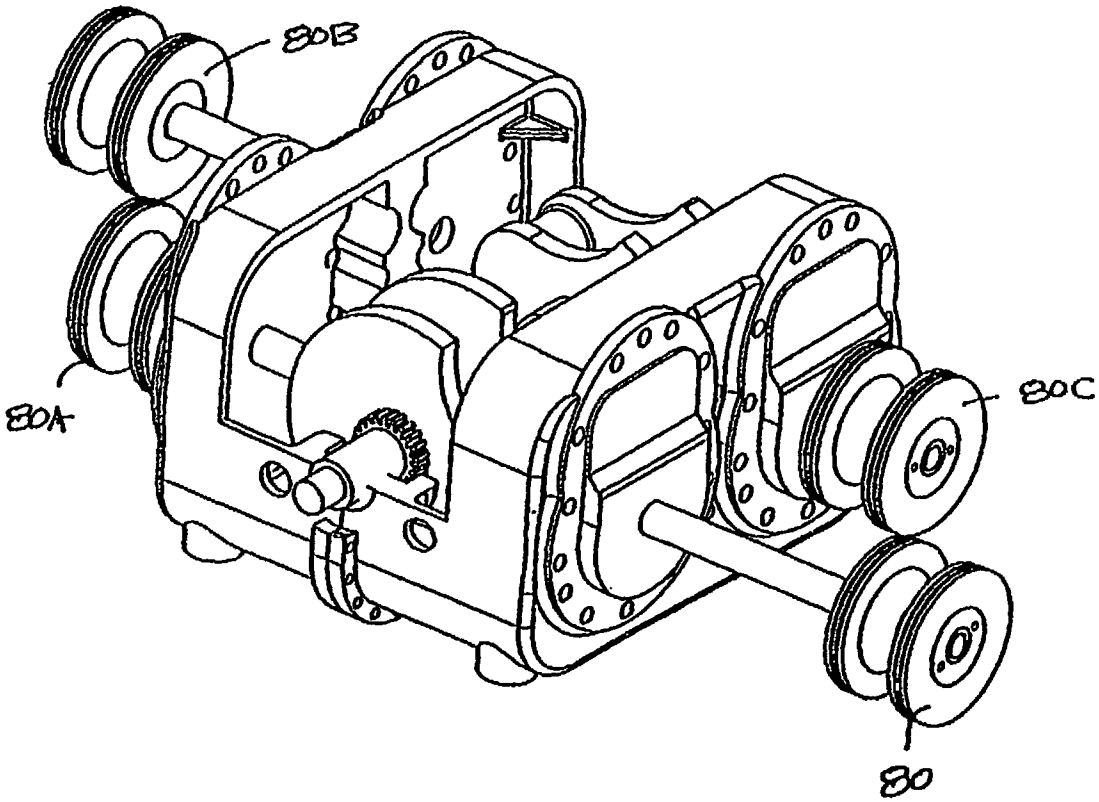
FIGS. 23 and 24 illustrate an eight cylinder configuration.

FIGS. 21 and 22 area schematic representation of the firing sequence of the device when operated as a combustion engine with the cylinders arranged in side-by-side relationship. Opposed cylinders will operate in the same sequence. FIG. 21 shows two pistons operating in a four cylinder chamber configuration. The dual cylinder chambers 50, 50A have been designated by the numerals 1 and 2 and the dual cylinder chambers 50, 50A in the adjacent cylinder of the crankcase have been designated 3 and 4. The pistons 80 are connected to a yoke 310. When ignition occurs in chamber 1, the associated piston rod 82 will move leftwardly as shown causing compression to occur in cylinder chamber 2. The intake and exhaust valves associated with chambers 1 and 2 are both in the closed position.

Cylinder chamber 3 expands in volume as its piston moves rightwardly. The associated intake valve is open and the exhaust valve is closed. Cylinder chamber 4 is decreasing in volume and its intake valve is closed and the exhaust valve is open exhausting the products of combustion contained in this chamber.

The sequence described occurs through 180° of rotation of the crankshaft. As the crankshaft continues to rotate, cylinder chamber 2 will fire causing the air fuel mixture in the chamber to combust. This will move the piston leftwardly. Cylinder chamber 3 is in compression, and cylinder chamber 4 in the intake portion of the combustion cycle. Cylinder chamber 1, which previously fired, is now charged with air and fuel through the manifold and the intake valve is open. Cylinder chamber 4 is in the exhaust portion of the firing sequence and its exhaust valve is open and the intake valve closed.

FIG. 22 illustrates the firing sequence for an eight cylinder chamber engine which is believed to be self-explanatory.

The translation of reciprocating to rotary motion occurs at the yoke 310 and flywheel 400. The yoke 310 of this type is sometimes termed a "scotch yoke." The yoke assembly, best shown in FIGS. 1, 3A, 8 and 11, include a yoke 310 comprised of two identical interlocking sections 312, 312A which are inverted relative to one another at assembly. Each section is generally L-shaped having a vertical side 316 and a leg 318 with a projecting connector section 320. The inner side of the vertical sections 312 each define a recess 322 which receives the connector 320 of the opposite section so that, when assembled, the yoke is generally rectangular or oval defining a slot 330. The slot 330 may be vertical or slightly angular extending at an angle between 10° to 25°.

It will be seen from FIG. 8 that each of the yoke sections is identical so that only one part is required to be manufactured. The yoke is assembled by inserting the projecting connectors 320 at the end of the arms into the cooperating recess 322 in the opposite section. The components can then be joined by suitable fasteners such as yoke bolts 338. The inner end of the piston rods extend through bores 334 in the vertical leg of each of the yoke sections. The inner ends of the rods have annular grooves 340 which receive U-shaped rod locks 336 in slots 335. The rod locks 336 comprise mating halves which are secured together by a fastener 350. Each lock section defines a generally semi-circular surface which is engageable in the annular groove 340 at the end of the associated piston rod, as best seen in FIG. 1A.

It will be appreciated that when the device is operated as an engine, the piston rods reciprocate due to the driving force exerted on the pistons by combustion pressure. The yoke 310 will be caused to reciprocate by the piston rods rotating the crankshaft. The reciprocation of the yoke will, in turn, impart rotation to the output shaft 180 as the flywheel 400 and crankshaft associated bearing reciprocates both vertically and horizontally driven by the yoke. The yoke is supported at the rear crankcase wall at stub shaft 181 in bearings.

Figure 11:
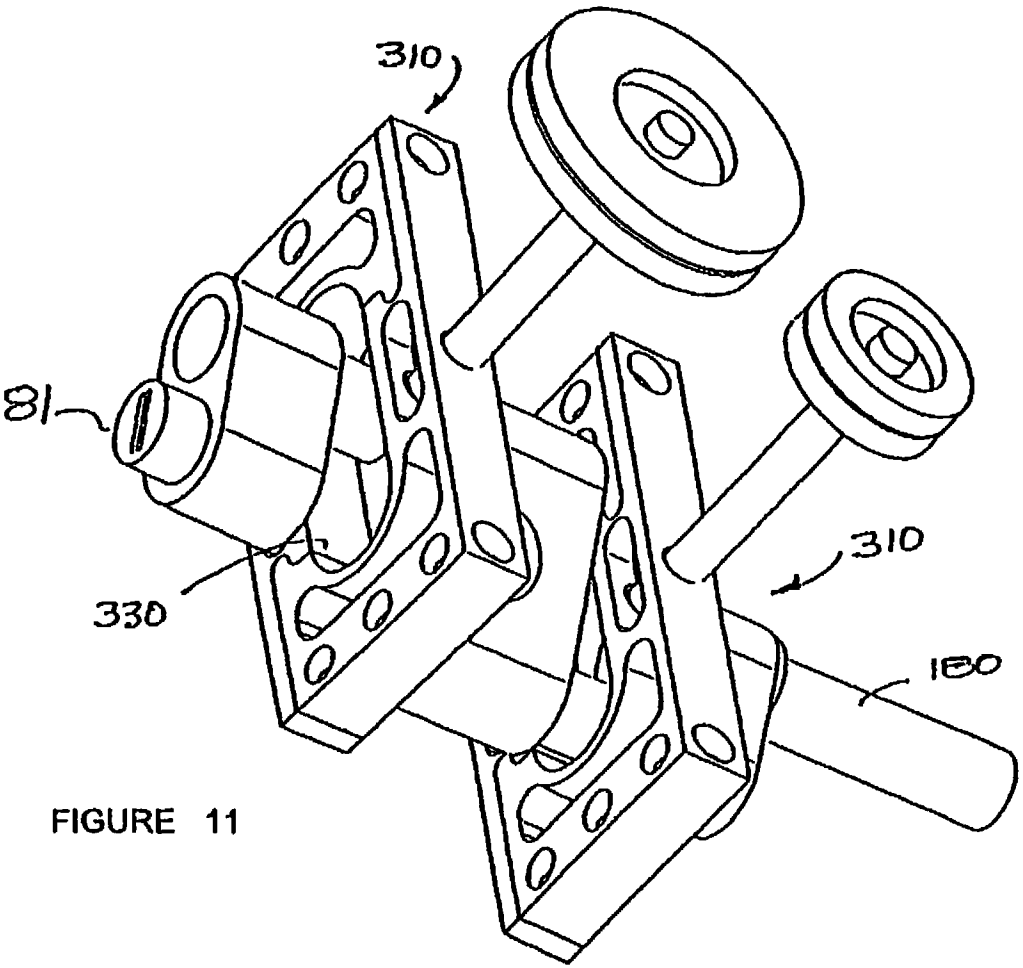
FIG. 11 is a perspective view of the yoke and piston configuration for adjacent cylinders.
Figure 12:
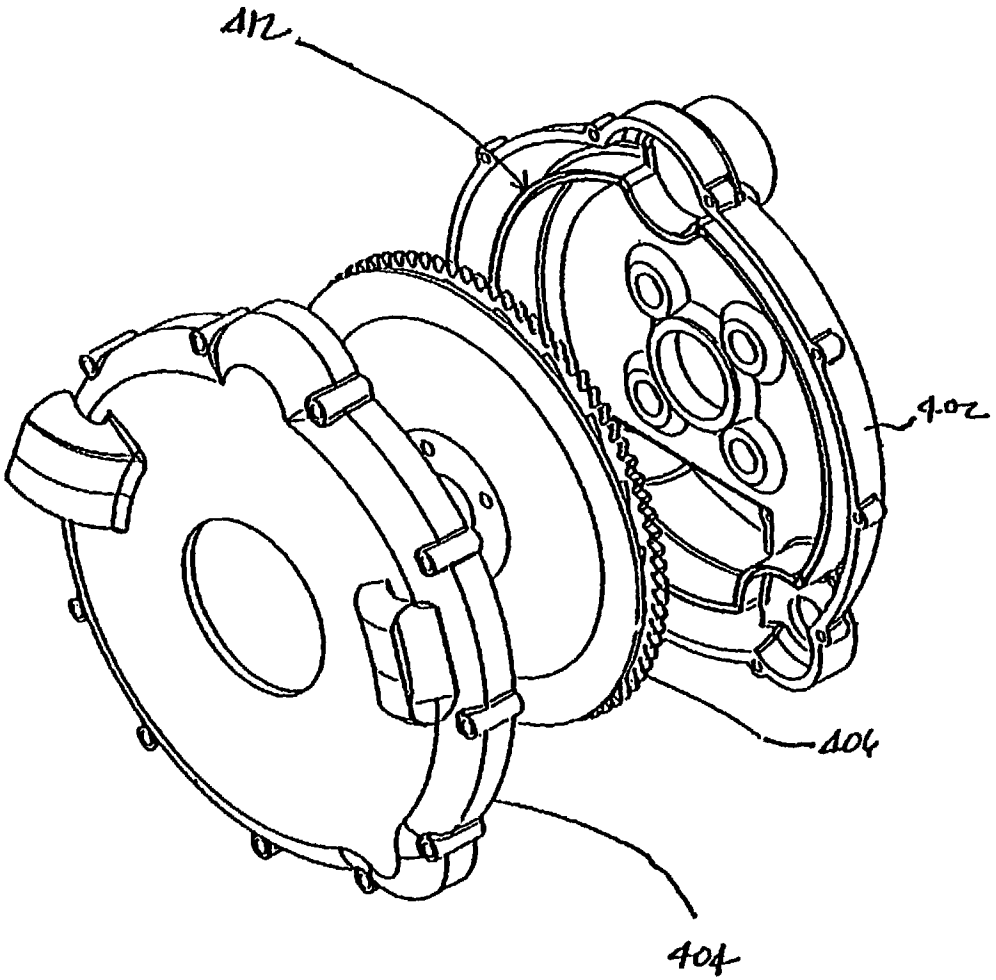
FIG. 12 is an exploded view of the flywheel.
Figure 13:
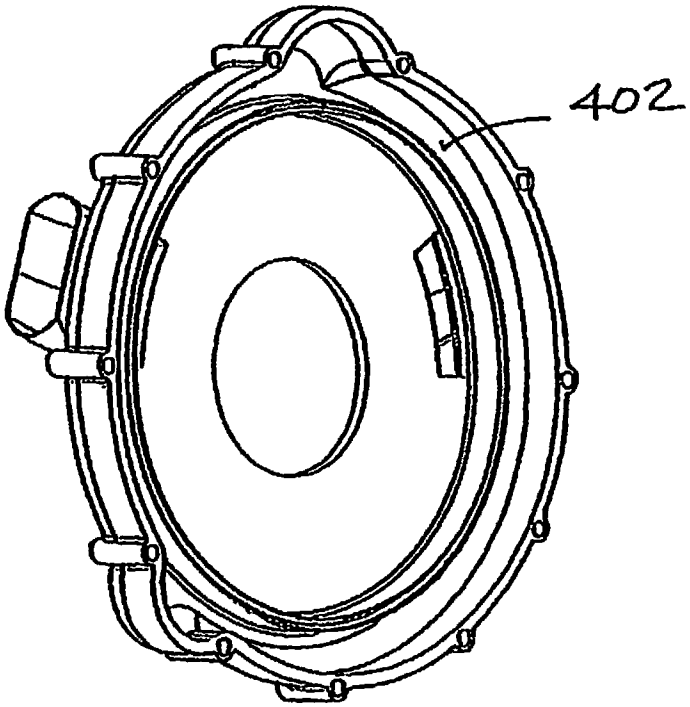
FIG. 13 is a perspective view of the interior of the back bell housing.
Figure 14:
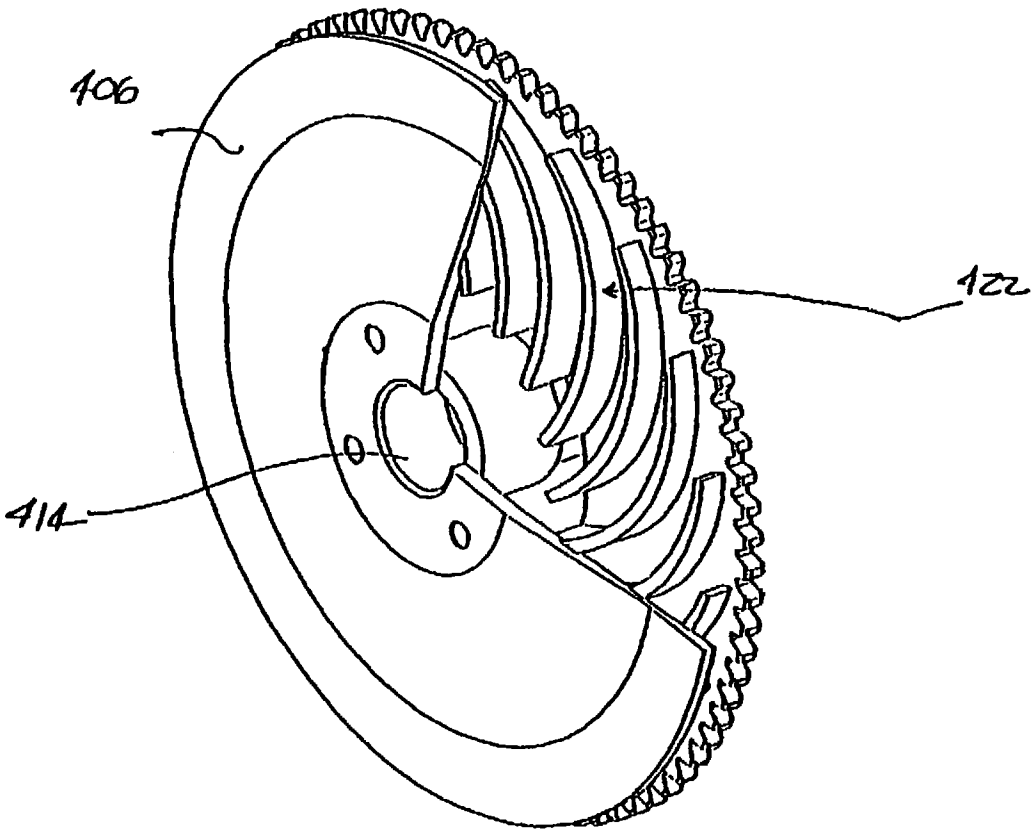
FIG. 14 is a perspective view of the back of the flywheel impeller.
Figure 15:
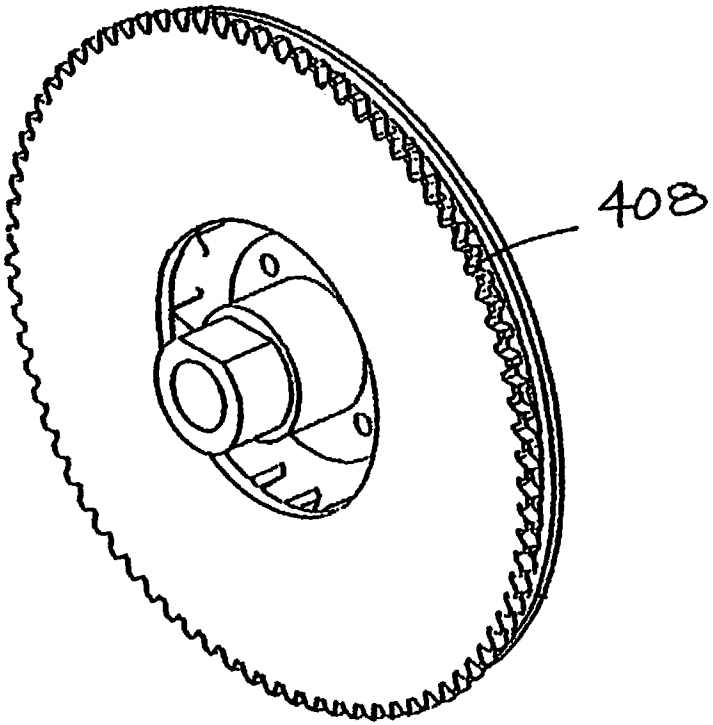
FIG. 15 is a perspective view of the front of the flywheel impeller.

Referring to FIG. 11, an embodiment is constructed similar to that described with reference to previous FIGS. with the principle modification being the cylinders and crankshaft are not axially aligned and opposed, but rather are parallel to one another. This change requires modification to the yoke assembly as shown and is applicable to both engine and compressor embodiments.

The reciprocation of the yoke is guided by guide rails 364, 366, extending axially along the inner side of the upper and lower walls of the crankcase housing refer to FIG. 1. The guide rails each have a projecting surface or flange 367 which is received in corresponding slots 370 and 370A in opposites edges of the yoke. The guide rails reduce vibration and assists in the flywheel smoothly passing through top dead centerand bottom dead center positions.

Figure 3B:
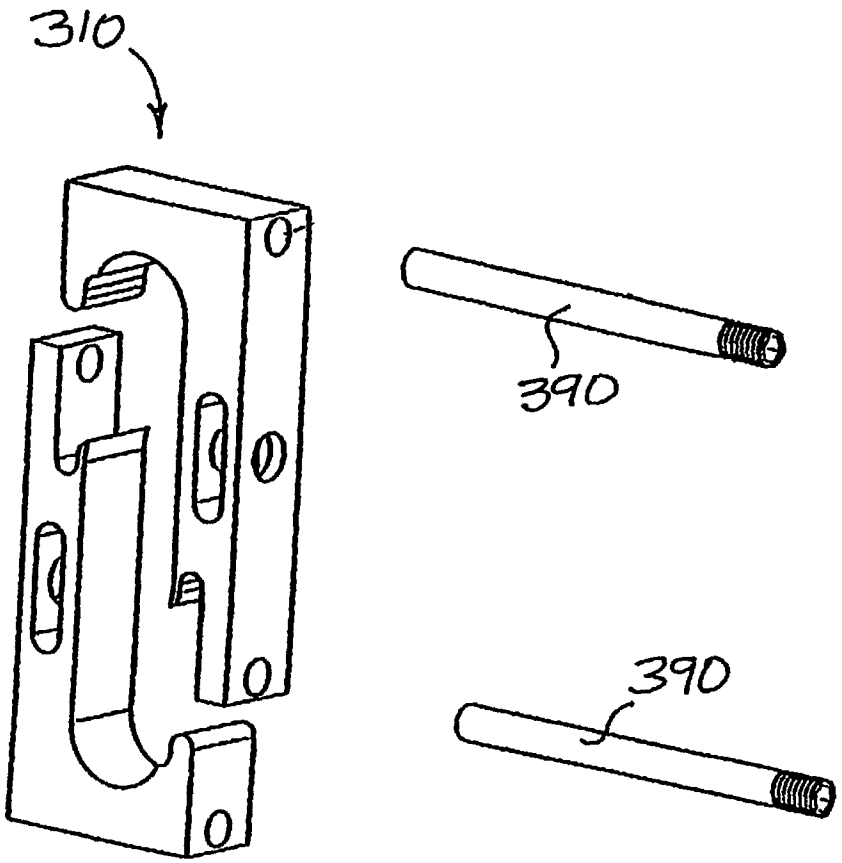
FIG. 3B shows an alternate yoke arrangement.

FIG. 3B illustrates an alternate guide arrangement in which guide rods 390 extend through bores 392 in the yoke 310 having opposite ends. One end seats in the crankcase wall 20 and the other is threaded into the opposite wall 22.

As shown in FIG. 3A, a drive assembly 372 has front and rear spaced-apart plates 373, 373A which are interconnected by a yoke pin 374. The output shaft 180 extends from the center of the plate 373 and through an appropriate seal assembly 375 in the crankcase cover which prevents oil leakage. A stub shaft 181 is seated in bearings at the rear of the crankcase housing. Generally, an oil bath is provided in the bottom of the crankcase which, due to the movement of the components, will distribute lubrication to the various surfaces. The drive assembly may have cutaway arcuate sections 376 for reduced weight. The yoke pin 374 extends through the slot 330 in the yoke and through yoke bearing 382. The yoke bearing 382 has a split cylindrical section and carries spaced-apart plates 384 on either end. The material of the bearing is a high quality steel. The surfaces of the yoke bearing engage the edges of the slot 330 in the yoke assembly as the yoke reciprocates. As reciprocation occurs, the yoke will translate the reciprocating motion to rotary motion at output shaft 180.

FIG. 11 illustrates the relationship of yokes 310 in a two cylinder side-by-side arrangement.

Referring to FIGS. 12 through 16, details of the flywheel assembly 400 are shown. The flywheel assembly has front and rear bell housings 402, 404 which are bolted together to receive the flywheel 406. The flywheel has peripherally extending gears 408 to receive the mating gear of a conventional starter 410 which can be mounted to the front bell housing at opening 411. A pressure seal 412 extends around the interior of the front bell housing 402 so the flywheel assembly may also act in the manner of a supercharger to deliver air to the engine via vanes 422. A power take-off gear is mounted to the flywheel at 415 and the stub shaft 181 is pinned to the flywheel at bore 414. FIG. 1B, which is an 8 cylinder version shows the mounted position of the flywheel.

Figure 16:
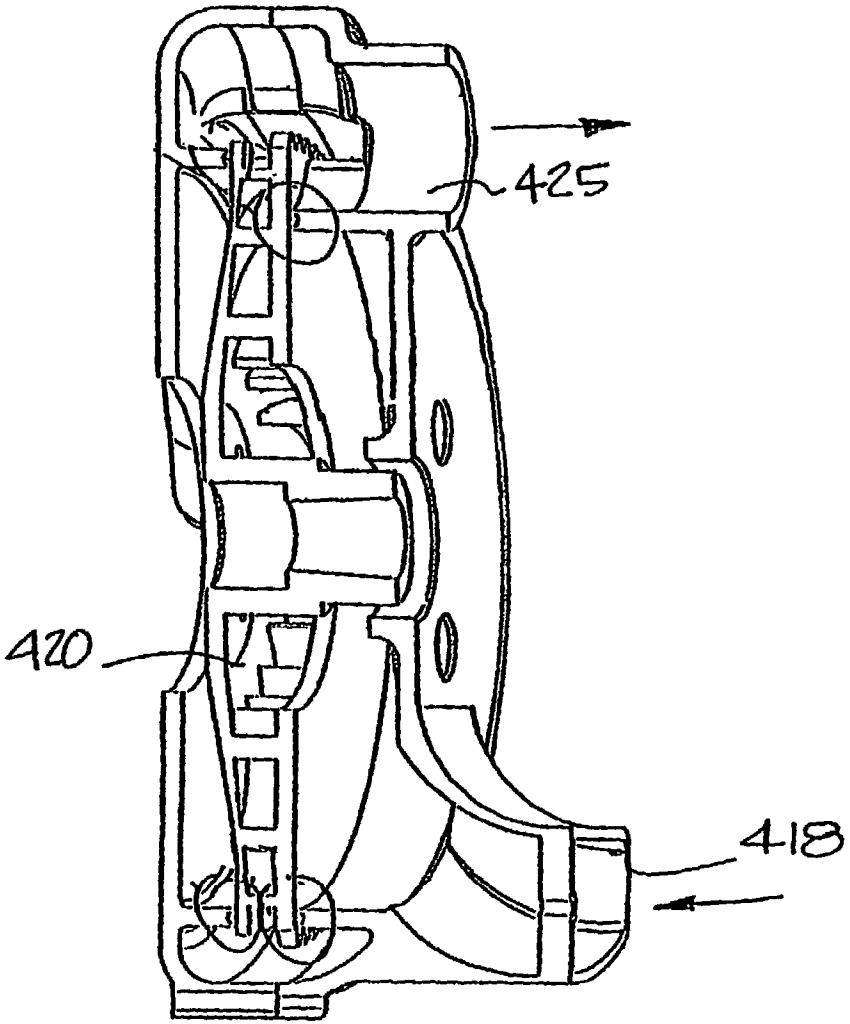
FIG. 16 is a cross-sectional view of the flywheel illustrating the air flow.

As seen in FIG. 16, low pressure air can enter at the intake 418 and is drawn into the chamber 420 at the inner ends of the curved impeller vanes 422 on the flywheel. The air is pressurized by the rotation vanes 422 and discharged at the outer edge of the flywheel into the high pressure outlet 425 which is connected to the fuel delivery system, either a carburetor or fuel intake manifold. Thus, the flywheel assembly serves multiple functions to dampen the vibrations and smooth operation of the engine to provide supercharging and also to provide a gear surface for engagement by the starter.

Figure 24:
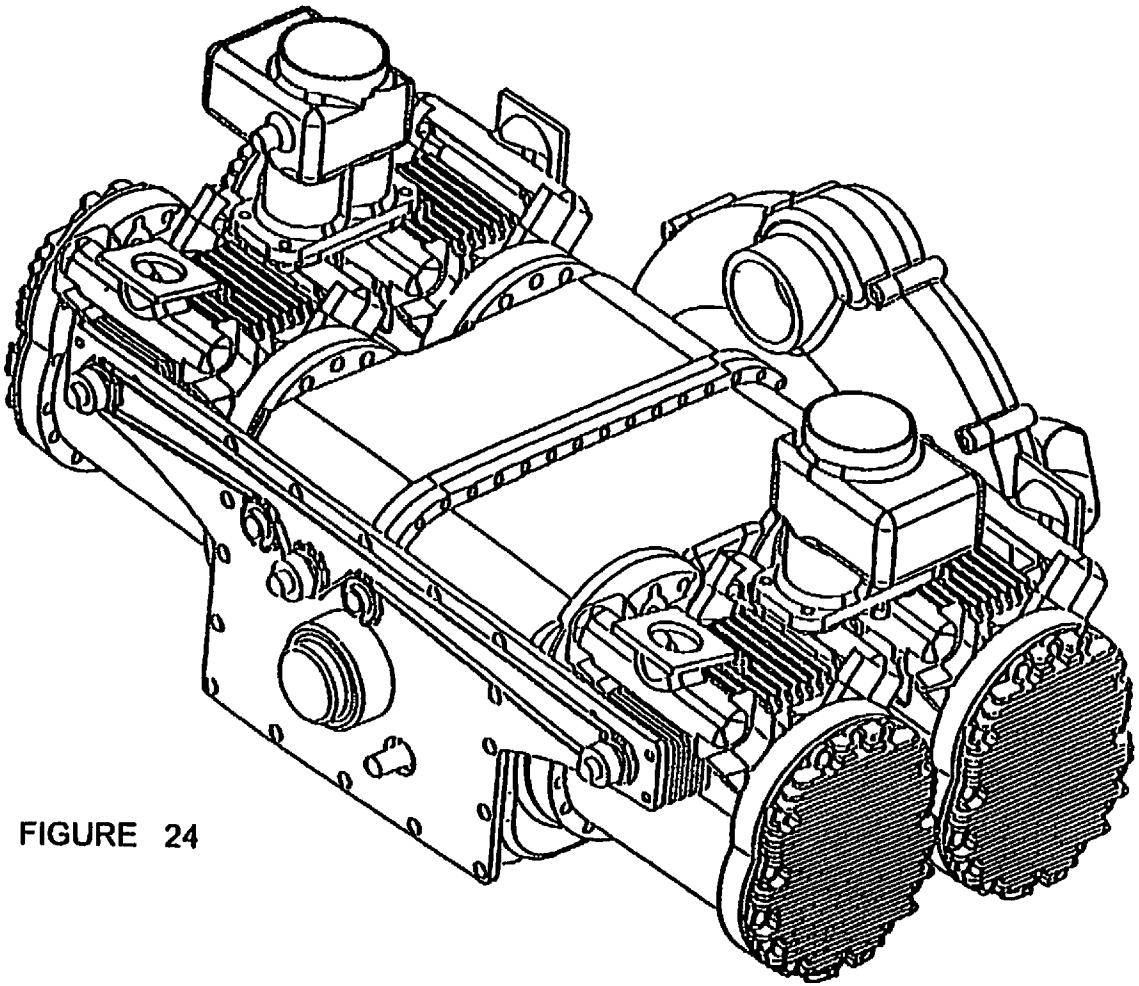

FIGS. 1B and 24 show how the displacement of the design can be increased by enlarging the crankcase to accommodate additional cylinders and pistons 80, 80A, 80B and 80C using essentially the same components. An additional yoke assembly has been added and the crankcase enlarged.

As described above, the air fuel mixture can be delivered by various means such as carburetors or fuel injectors. Similarly, conventional valves such as poppet valves may be used to control the intake and exhaust flow into the cylinder chambers.

Figure 17:
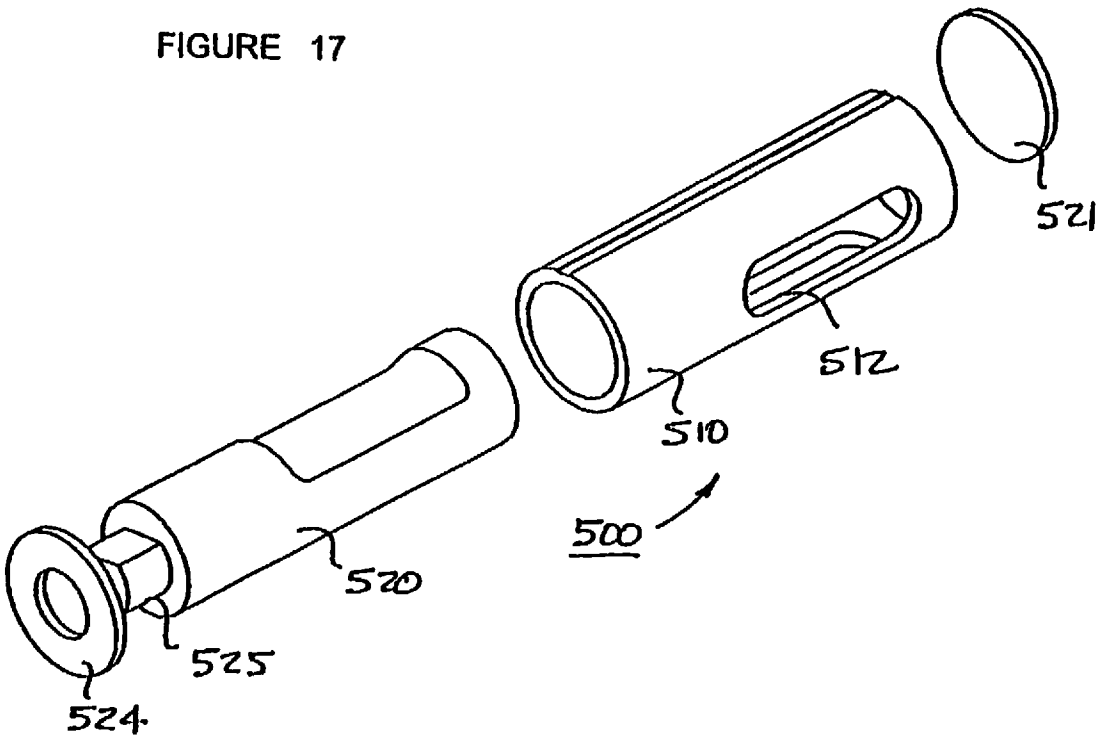
FIG. 17 is an exploded view of an alternate valving arrangement utilizing spool valve.
Figure 18:
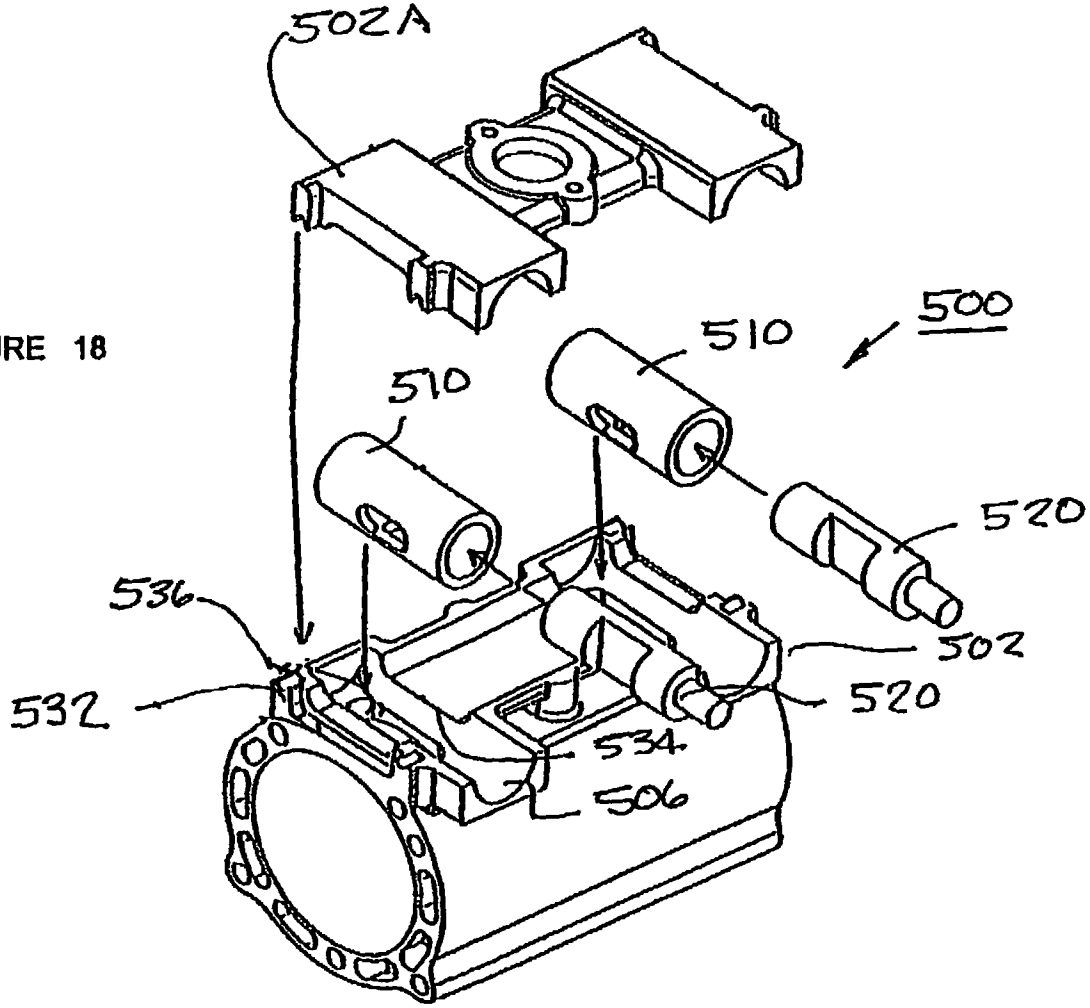
FIGS. 18 and 18A show an engine according to the present invention using spool valves as seen in FIG. 17.

FIGS. 17 and 18 show an alternate valving arrangement which may be used to replace the conventional poppet valves. A valve assembly 500, as shown, is associated with each of the cylinder chambers to be appropriately mounted in a valve housing 502 on the cylinder adjacent the cylinder chamber and generally perpendicular to the axis of the cylinder. Each valve housing 502 defines a bore 506 which receives a sleeve 510, preferably of a ceramic material or high quality steel such as 57. The sleeve has a pair of opposed elongate ports 512, 512A. A cylindrical valve member 520 is received within the sleeve. One end of the housing is closed by an end wall 521. The other end has a seal 524 through which a reduced diameter section 525 of the sleeve extends. The valve body has a recessed section 528 which extends to a depth less than the diameter of the sleeve. The valve body is rotated by a timing belt or chain which engages a drive gear on the projecting shaft portion 525. The valve manifold body 502 has opposed outlet ports 532, 534 connecting to either the exhaust on intake manifold. Port 536 selectively communicates with the adjacent cylinder chamber. As the valve body 520 is rotated, ports 512, 512A will be selectively and cyclically placed in communication with the associated cylinder chamber via port 536 to either allow air fuel mixture to enter the cylinder chamber, to allow exhaust gases to exit the cylinder chamber or to close off the chamber during compression and ignition.

Preferably the sleeve 520 is ceramic. The surface finish on the outer side of the spool and the inside of the sleeve are critical in the function of the assembly. Both surfaces must be highly polished to hold compression as the cylinder, as well as to allow the entire assembly to properly operate with little or no lubrication. The valve body defines ports including an outlet port, an inlet port and a port to the cylinder chamber. The body can be made in a single section or made of ceramic manufactured in semi-circular sections and joined by application of a suitable cement. Suitable ceramics include zirconia nitrite and silica nitrite. The end of the valve body has a reduced shaft section which is mentioned above can receive a gear or pulley so the valve body is rotated at the appropriate rotational speed by a timing chain or belt.

In FIG. 18, the valve assembly is clamped to the valve body housing by manifold cover 502A.

Figure 18A:
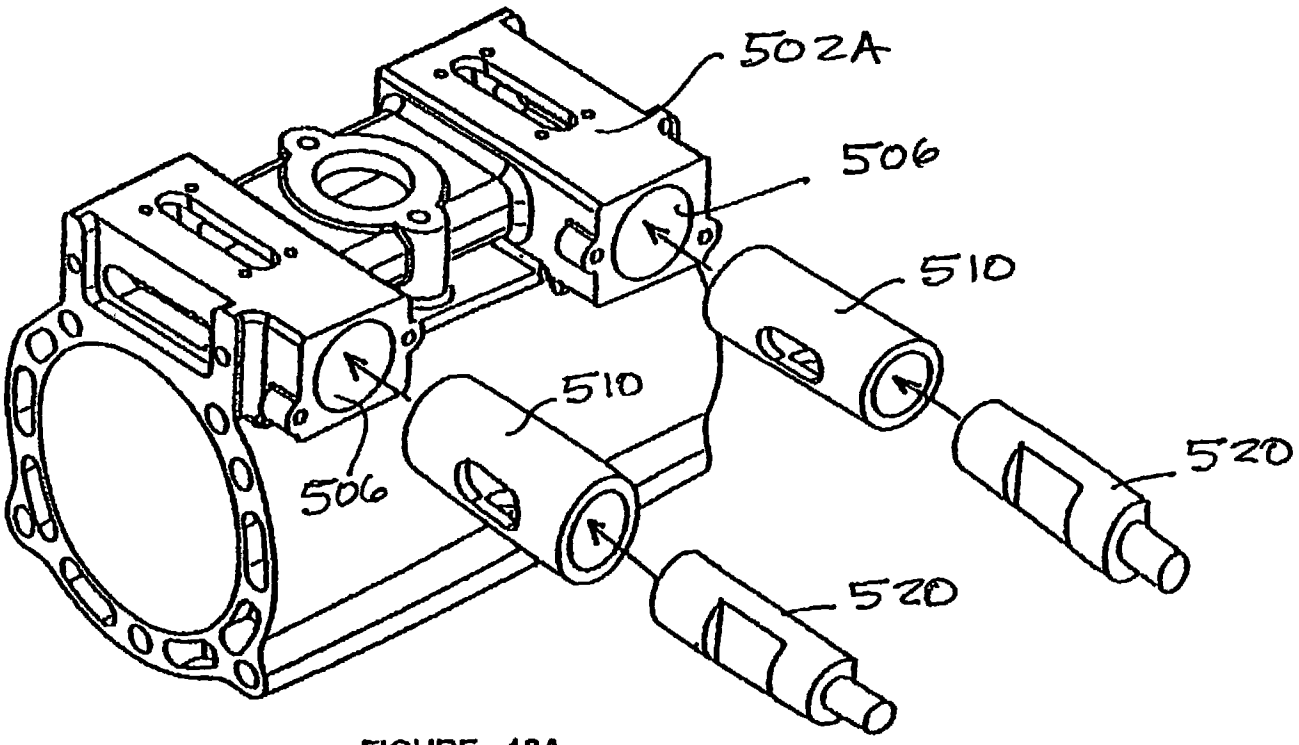

In FIG. 18A, the valve assemblies are pressed into the valve housing.

Figure 19:
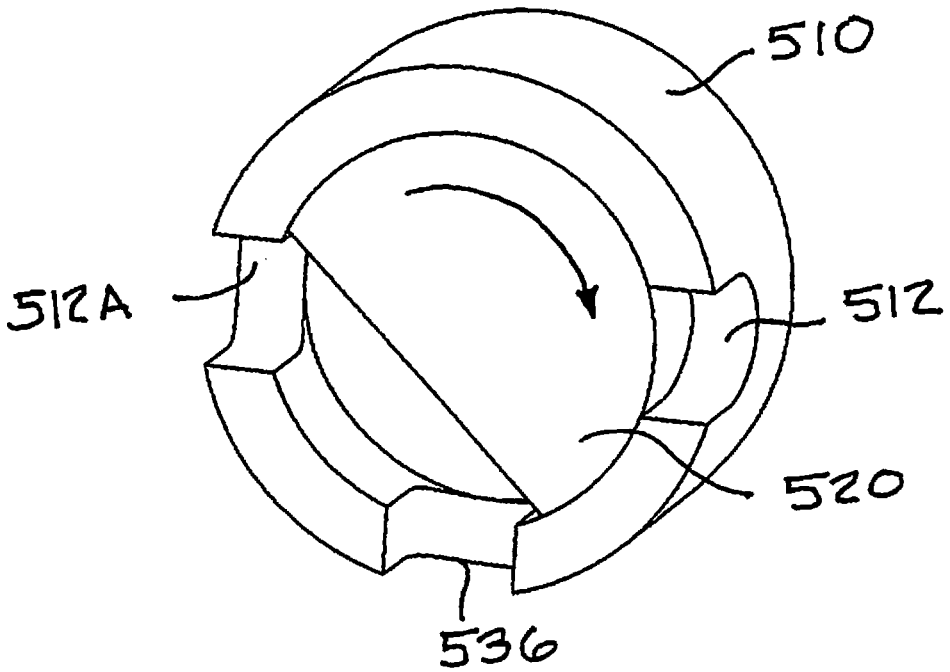
FIGS. 19 to 19C are perspective cutaway views showing operation of the valve spool of FIG. 17.
Figure 19A:
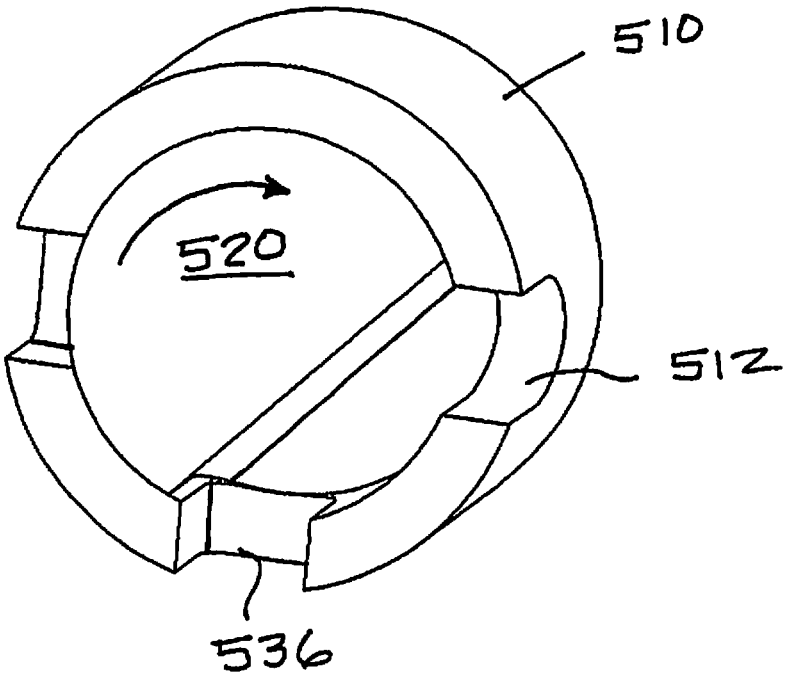
Figure 19B:
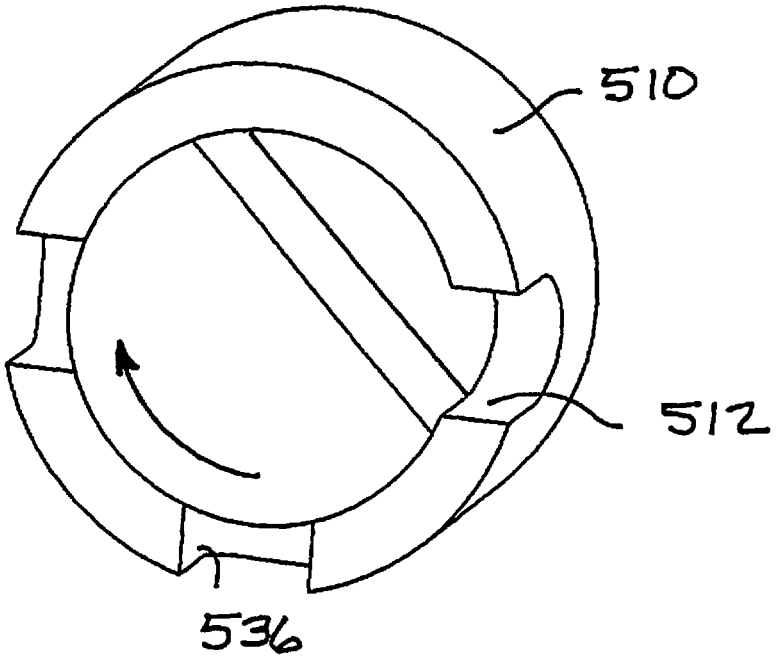
Figure 19C:
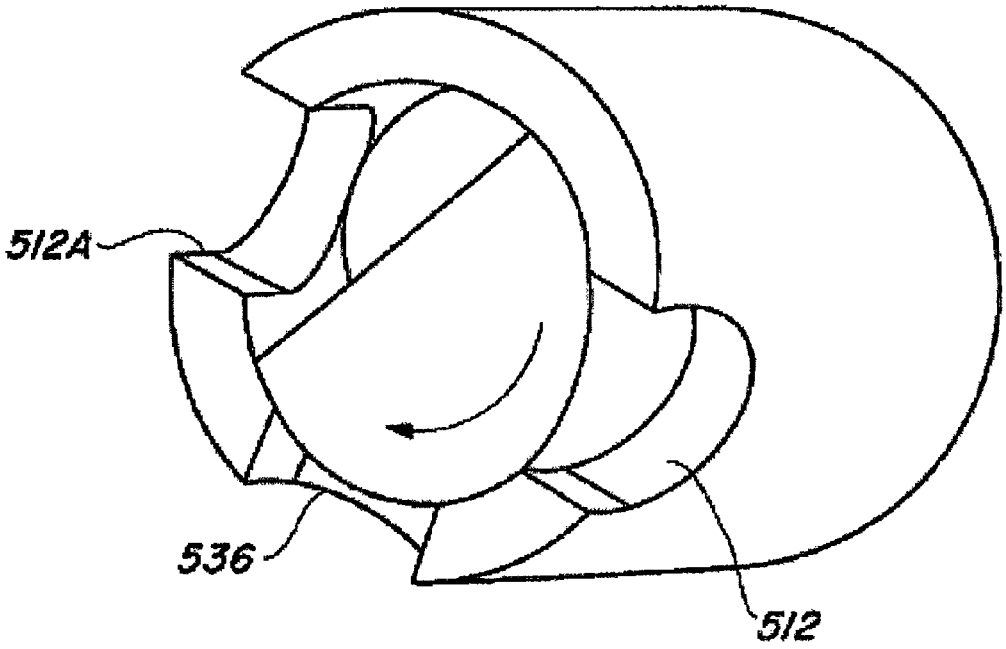

FIGS. 19 to 19C illustrate sequentially the operation of the rotary valve. During compression and firing, the inlet intake and exhaust ports are blocked. On the intake portion of the cycle, fuel is directed from the intake port 512A into the engine port 536. In the sequence after firing, the cylinder is connected to the exhaust port for exhausting gases.

Figure 20:
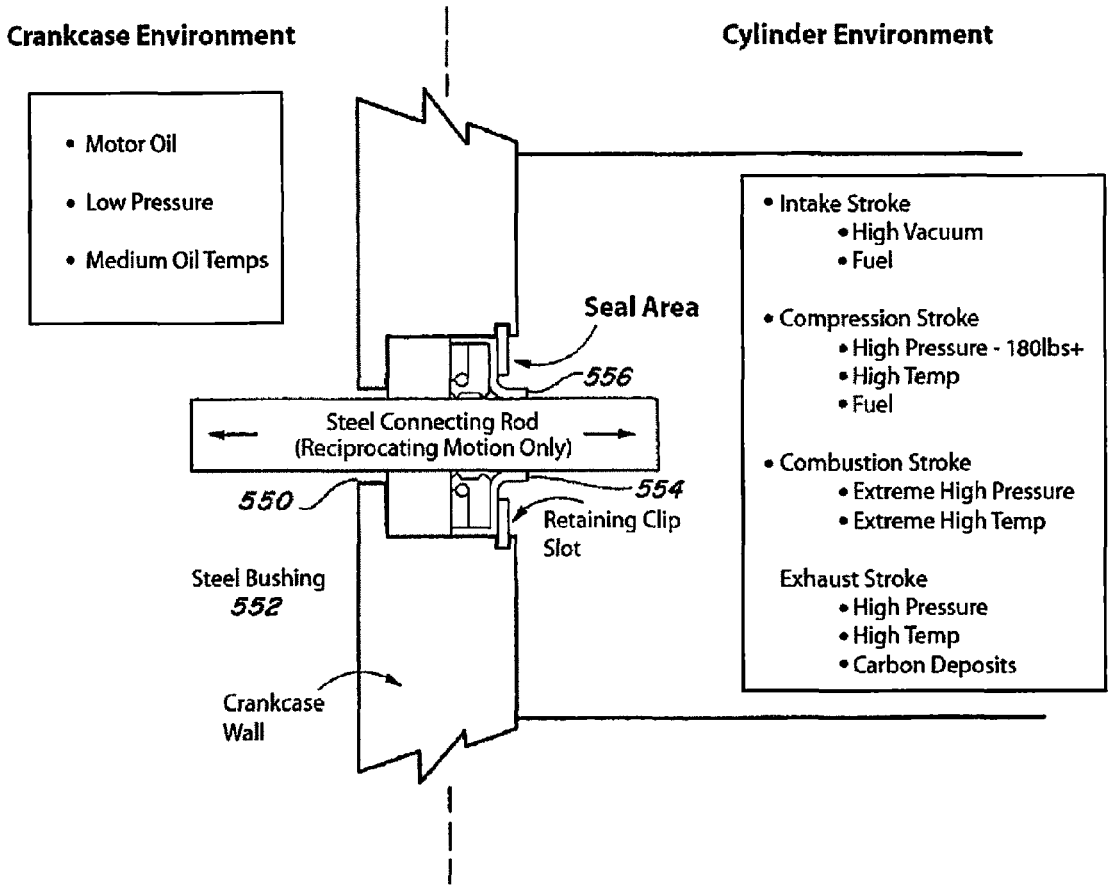
FIG. 20 is a schematic illustration of the connecting rod seal assembly.

FIG. 20 schematically illustrates the seal existing between the crankcase wall and crankshaft. A bore 550 extends in the crankcase wall and receives a steel bushing or a ceramic bushing 552. Adjacent the steel bushing recessed in the crankcase wall is a rubber wiper 554 to maintain vacuum pressure and keep oil from entering into the adjacent cylinder chamber. A pressure seal 556 abuts the wiper and the entire assembly is held in place by a depending flange of threaded retainer member which engages threads in the crankcase wall.

Figure 25:
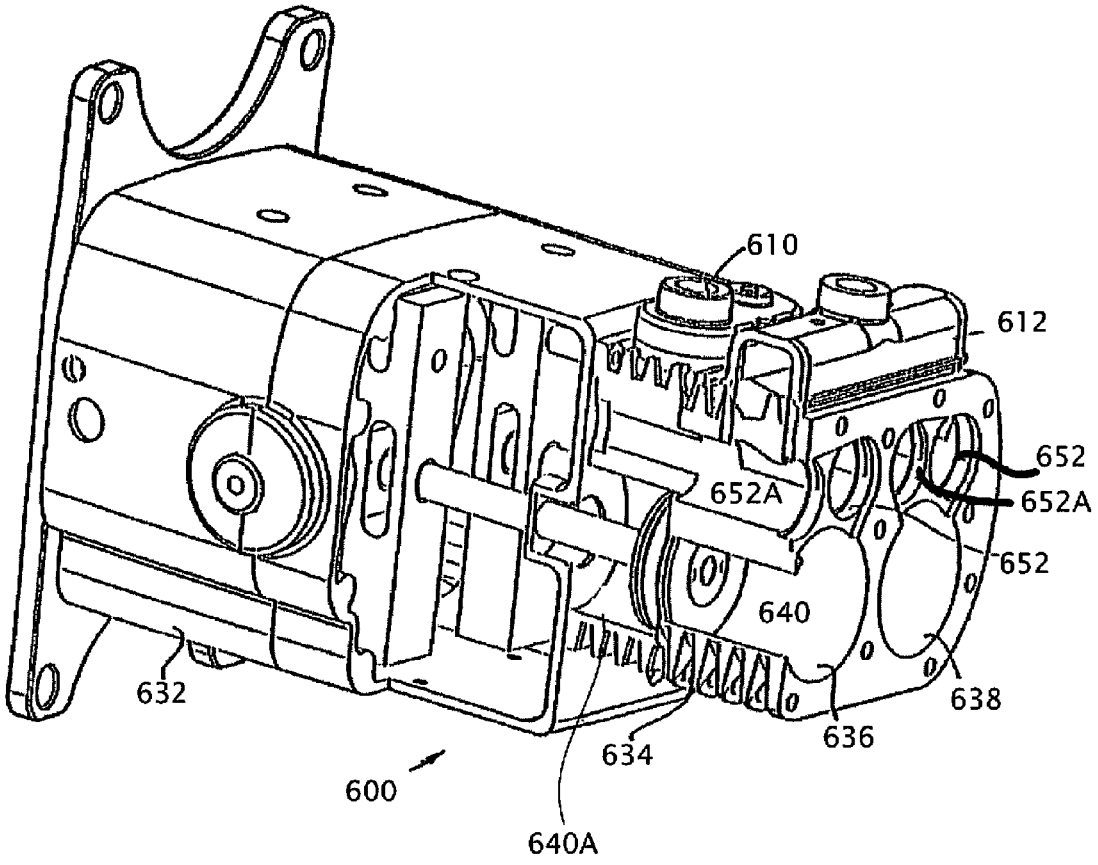
FIG. 25 shows an alternate embodiment in which the reciprocating device is conFIG.d as a compressor.
Figure 27:
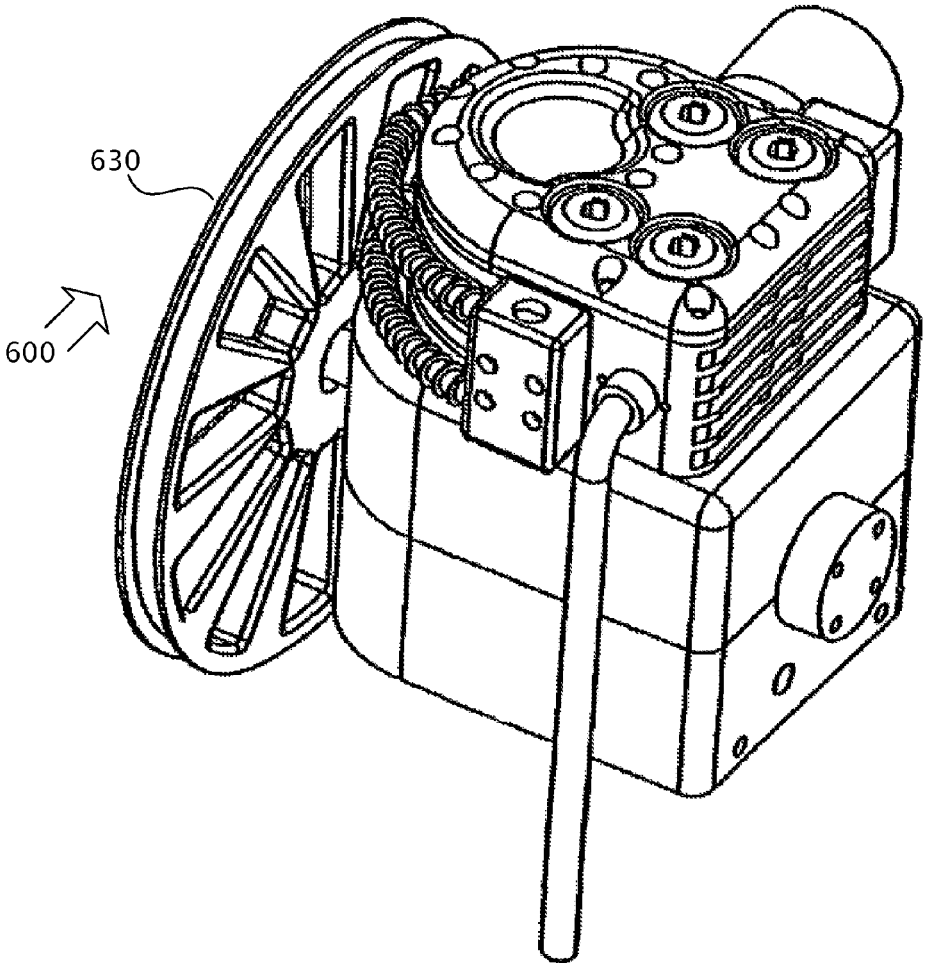
FIG. 27 is a perspective view of the compressor of FIG. 25.

In the foregoing description with reference to drawing FIGS. 1 to 24, the reciprocating device has been primarily described as an engine. It will be apparent to those skilled in the art that the device can also be used as a compressor by making slight modifications. As shown in FIGS. 25 and 27, the reciprocating device 600 is generally as has been previously described, but spark plugs, fuel delivery and ignition systems have been eliminated. The input shaft has been connected to a suitable drive such as a small electric motor and a flywheel 630.

The valve inlet ports 610 are in communication with the source of fluid to be compressed such as air via line. The outlet or exhaust manifold 612 is in communication with a reservoir such as a compressed air tank. As the compressor is rotated, the crankshaft and the dual chamber pistons will be reciprocated through the yoke assembly and piston rods. The fluid to be compressed will be drawn in and compressed every 180° of crankshaft operation.

Figure 26:
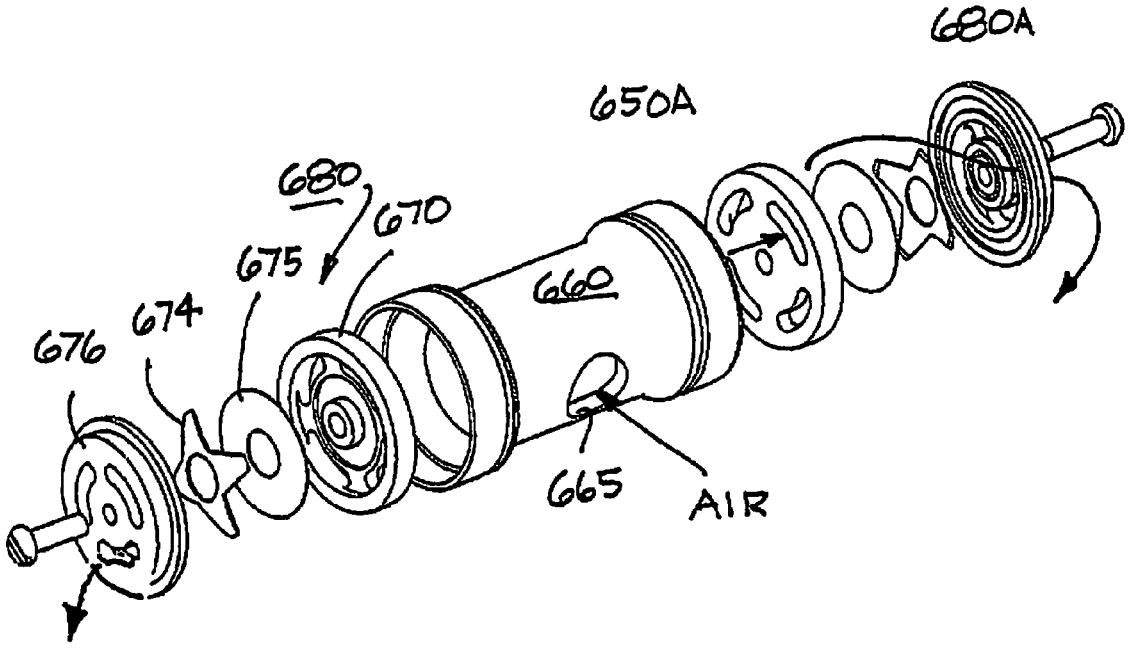
FIGS. 26 and 26A are exploded views of the valving arrangements for a compressor as shown in FIG. 25.
Figure 26A:
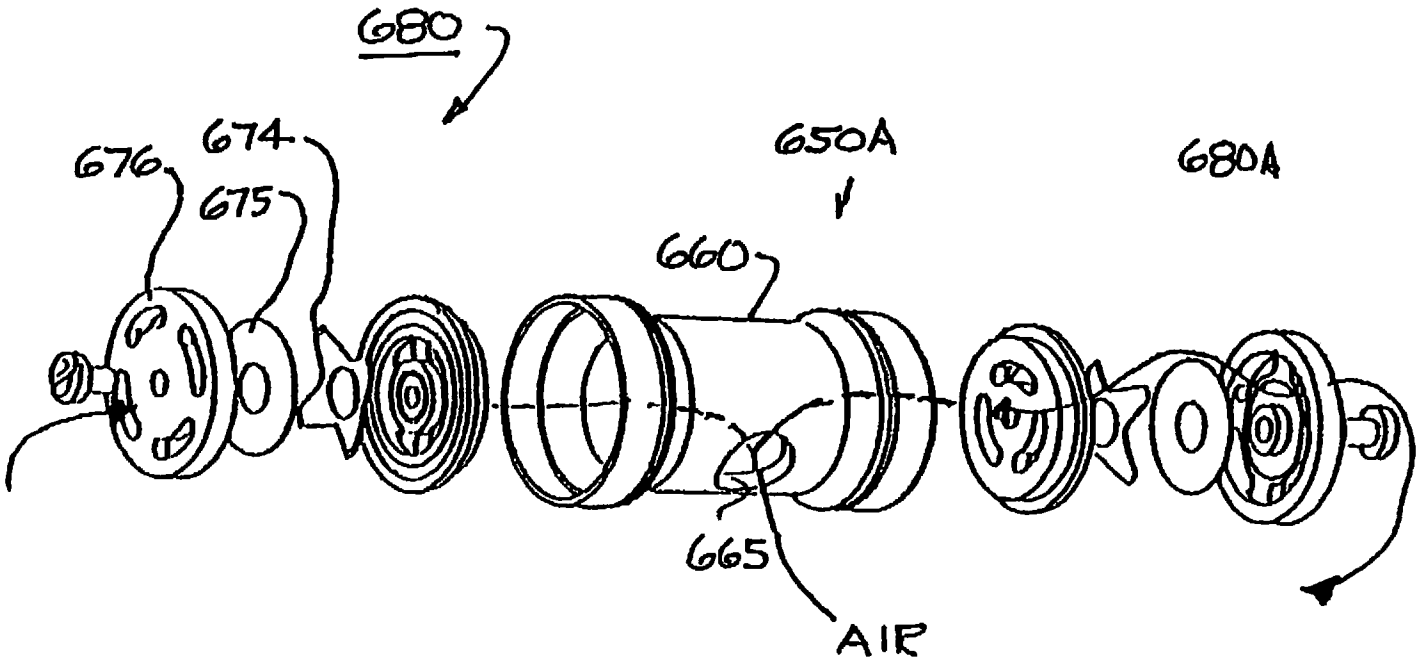

For compressor applications, poppet or rotary valves may be used, however the cartridge-style valves 650, 650A shown in FIGS. 26, 26A has been demonstrated to work well. The valves are received in valve receiving valve receiving bore 652, 652A adjacent each cylinder. Bores 652A receive the intake valve 650A and bores 652A receive the exhaust valve configuration 650 as seen in FIGS. 26 and 26A.

The intake valve assembly which is shown in exploded view in FIG. 26 consists of 5 components, a sleeve 660 having a port 665 and valve assemblies 680, 680A at both ends having a back-housing 670, star spring 674, reed disc 675, front housing 676 assembled into a simple reed type valve. The valve function is dependant on vacuum or pressure that is greater than the strength of the tension of spring 674. As an intake valve, the valve opens due to a vacuum created by the movement of the piston 80 away from the valve allowing outside air to be drawn through the port 665 in the front housing, around the reed disc 675 and spring then into the compression chamber through the openings in the back housing 670. When the piston reaches the end of the intake stroke the combination of spring tension and increased pressure will hold the reed disc closed against the housing diverting the high pressure air through an exhaust valve that is located in the same compression chamber.

The exhaust valve seen in FIG. 26A valve is identical to the intake valve only the reed disc 675 and star spring 674 are placed in the reverse position. This reverse position allows the high pressure created by the pistons movement toward the valve during the compression stroke to overcome the spring tension and open the FIGS. 28 and 28A illustrate schematically the operation of the valve in the intake and exhaust cycles as the pistons front housing 676, around the reed disc and spring and into manifold 685 and into a holding tank (not shown) through the openings in the back housing 670.

The valves are assembled into tubular sleeve 620 that will allow easy access for maintenance or replacement of the valves without the need to dismantle any major components of the compressor. Four cartridges are required for each compressor. These cartridges are extracted through the head by the removal of an access cap. The valve assemblies 680, 680A communicate with the chambers on either side of the piston via porting 690 that allows air to transfer in and out of the cylinders. This assembly is attached to the cap. When the assembly is inserted in the cylinder through access bores in the head it is secured in place by the tightening of the access cap. For removal, as the access cap is loosened it will act as an extractor pulling the cartridge from the cylinder.

Figure 28:
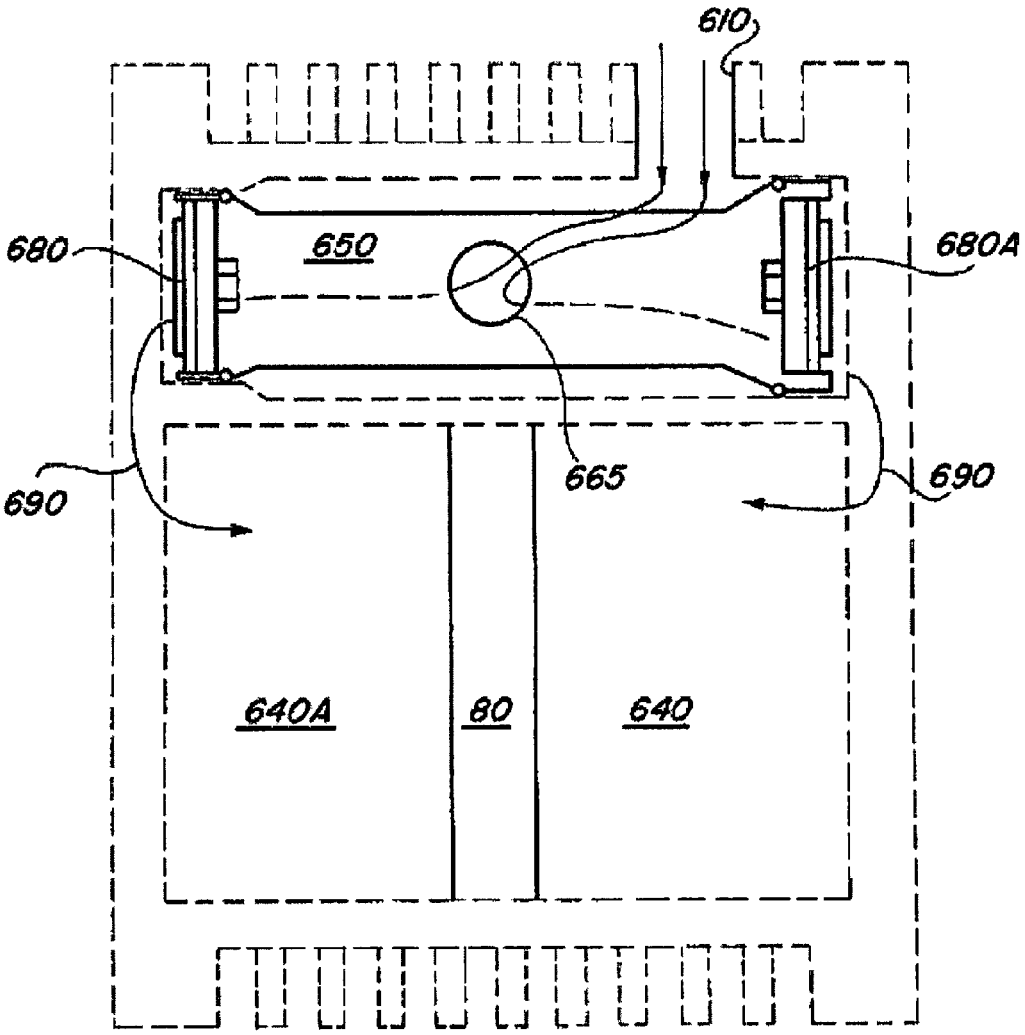
FIGS. 28 and 28A schematically illustrate the position of the valves of FIGS. 26 and 26A and the fluid flow path that occurs during intake and exhaust cycles.
Figure 28A:
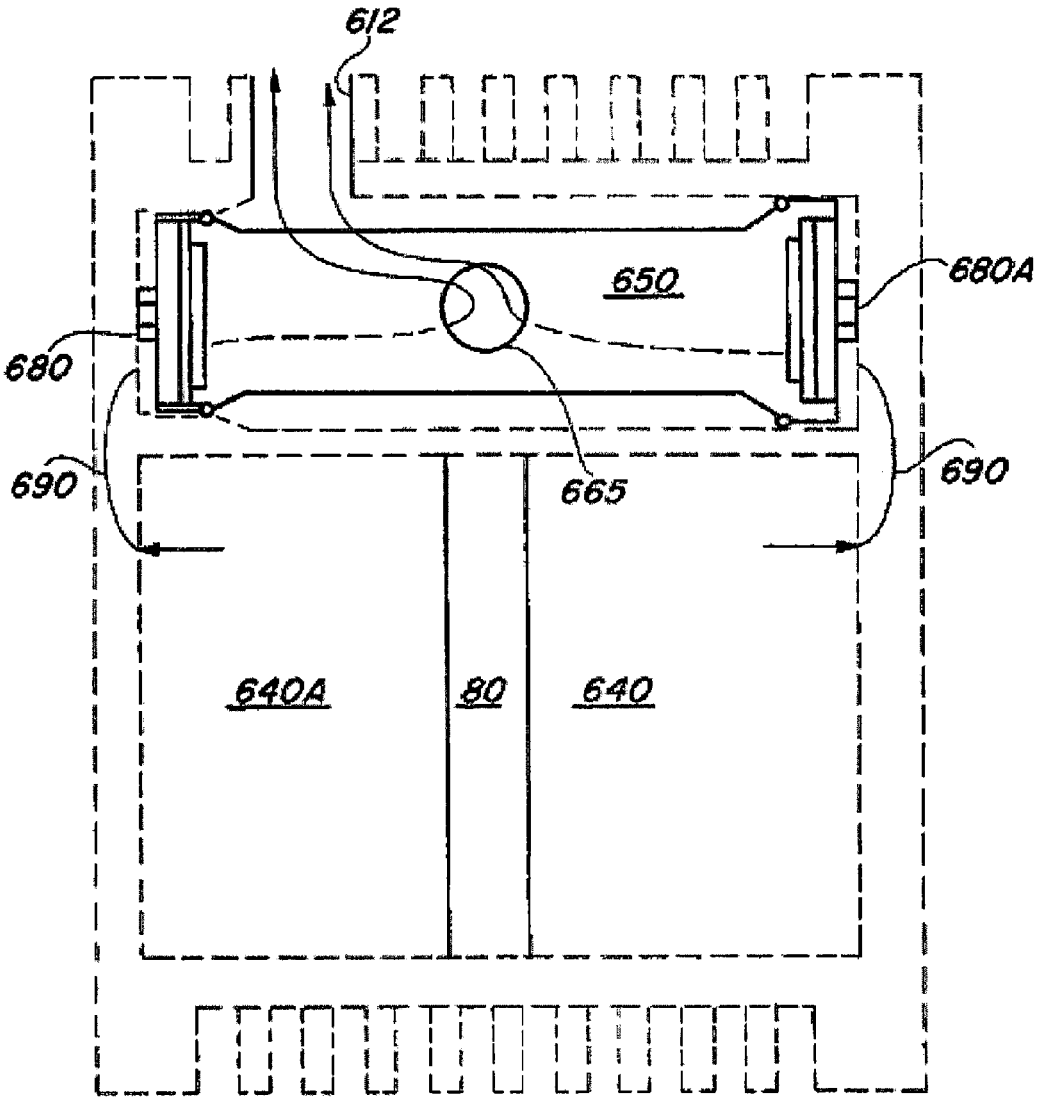

FIGS. 28 and 28A illustrate schematically the operation of the valve in the intake and exhaust cycles as the pistons 80 reciprocate driven by the scotch yoke.

Figure 29:
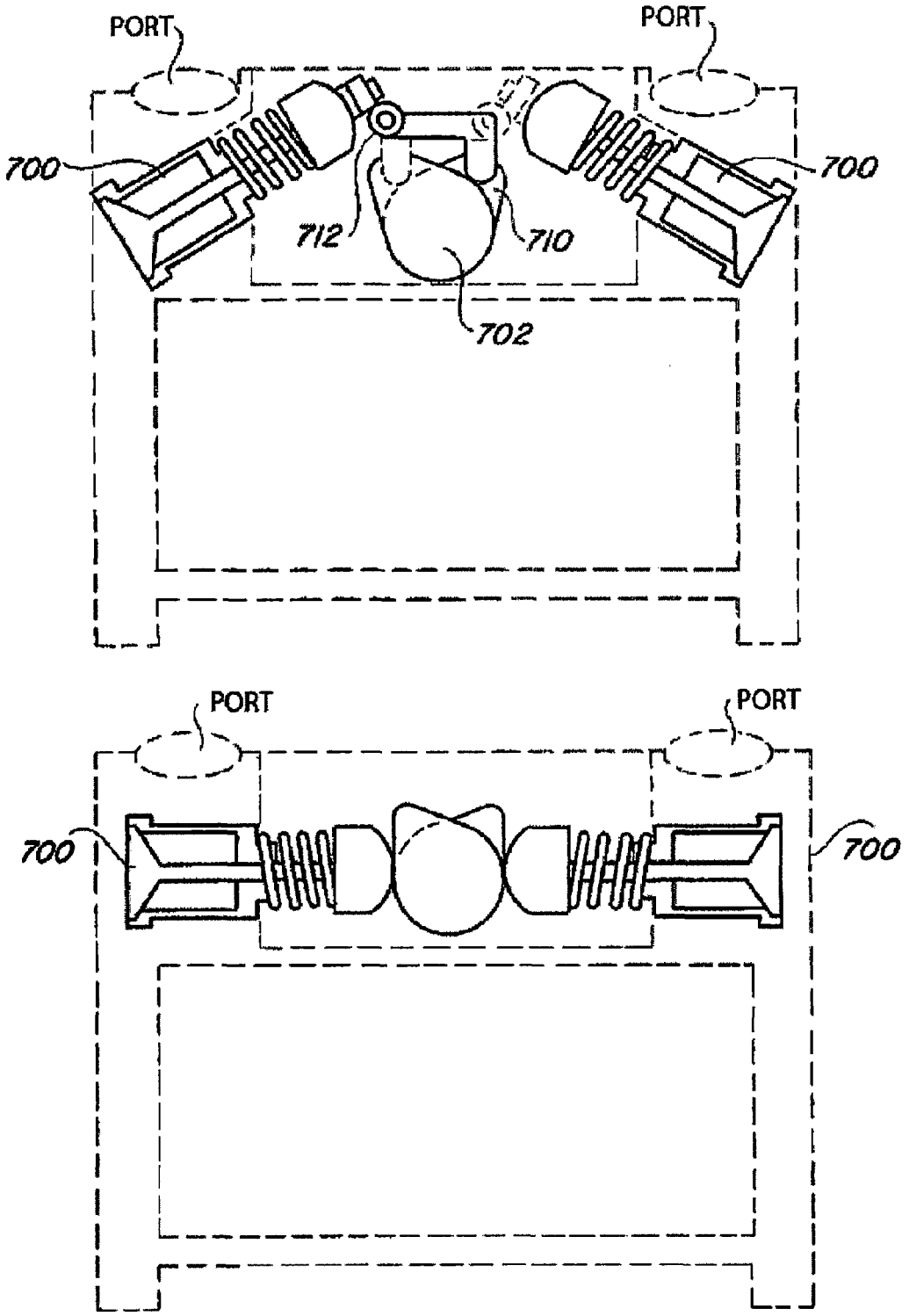
FIG. 29 shows an alternate arrangement for valving for an engine in which the valves are disposed at an angle.

Referring to FIG. 29, an alternate arrangement for the poppet valve assembly, as for example, is shown in FIG. 4. FIG. 27 shows a side view of the piston assembly modules arranged in a horizontal position, as described above. In FIG. 27, the valve modules 700 are shown at an upwardly inclined angle. Again, the cam 702 is operated either by a timing belt or timing chain 706 as previously described. The lobes 710 of the cam engage rocker arms 712 which, in turn, engage the lift surfaces 720 on the end of the cam assemblies as has been described above. However, in FIG. 27, the angled position of the valve assemblies allows the valves 701 to operate in a manner to increase the flow of air/fuel mixtures to the combustion chambers for improved performance. This angular orientation also permits expanded design capabilities of the cam because the contact points of the valve assembly are no longer on the horizontal passing through the center of the cam. This allows the cam to be designed with increased or decreased valve overlap, depending on the particular application. Also, with this arrangement, the rocker arm is utilized and designed for increased or decreased valve lift ratios depending on the application performance requirement and provides the ability to fully adjust the valves during assembly or routine maintenance.

One significant advantage of the present invention is its adaptability. Additional cylinders can easily be added increasing the horsepower output of the engine. This is accomplished as shown in FIG. 1B by increasing the size of the crankcase and adding additional cylinder assemblies. Each pair of opposed cylinder assemblies are connected to a crankshaft assembly on a common output shaft. The highly efficient design of the device facilitates a modular assembly approach in which, essentially, the same cylinder assemblies, valves, flywheels, yokes, crankshaft and the like can be used to manufacture devices of different size and capacity as for example units, having 2, 4, 6 or 8 dual chamber cylinder assemblies.

Figure 1D:
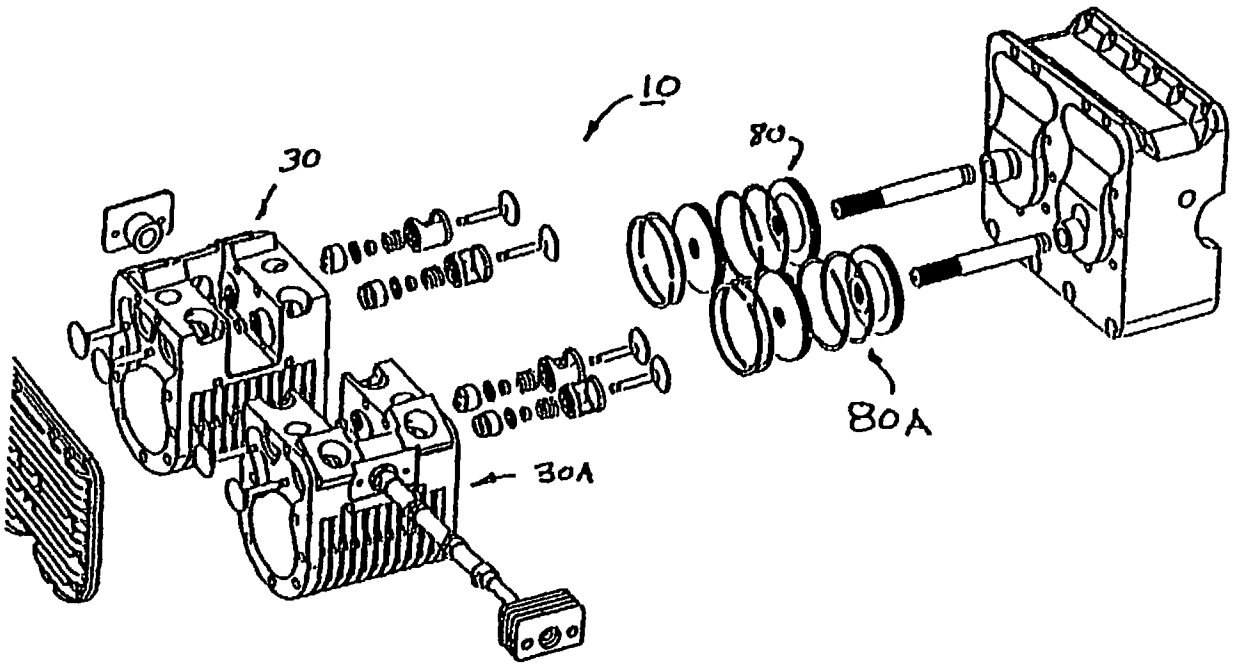
FIG. 1D shows multiple cylinders in a side-by-side arrangement.

FIG. 1D shows multiple cylinders arranged in a side-by-side arrangement. The adaptability and versatility of the device allows both compressor and engine units to be coupled together so the engine would power the compressor. It is also possible in multi-cylinder units, as seen in FIG. 1D, to utilize one or more cylinders as power units and utilize one or more cylinders as compressor units. Thus, a single device can be a combination engine/compressor.

It will be obvious to those skilled in the art to make various changes, alterations and modifications to the invention described herein. To the extent such changes, alterations and modifications do not depart from the spirit and scope of the appended claims, they are intended to be encompassed therein.

The invention claimed is:

1. A fluid compressor comprising:

(a) a case;

(b) first and second cylinder housings each having opposite outer and inner ends, said housings being connected directly to said case, each said first and second housing respectively defining first and second generally cylindrical piston bores;

(c) an outer cylinder head on the outer end of each of said first and second cylinder housings;

(d) an inner cylinder wall at the inner end of each of said first and second cylinder housings wherein said inner cylinder wall is a sidewall of the case;

(e) a first reciprocating piston in said first bore defining a first chamber between the first piston and the cylinder head and a second chamber between the first piston and the inner cylinder wall;

(f) a second reciprocating piston in said second bore defining a third chamber between said second piston and said cylinder head and a fourth chamber between the second piston and the inner cylinder wall;

(g) a scotch yoke in said case, wherein said scotch yoke comprises two identical, L-shaped, interlocking sections having a short leg with a curved projecting connector and a long leg with a curved cooperating recess, such that when the interlocking sections are inverted with respect to each other, the curved projecting connector inserts into the curved cooperating recess, said scotch yoke connected to said first piston by a first connecting rod and to said second piston by a second connecting rod, a pair of guide rods extending through bore holes in opposite ends of the scotch yoke, said pair of guide rods secured to opposite sidewalls of the case;

(h) a crankshaft having a bearing member reciprocable along said scotch yoke, said crankshaft having an input shaft connectable to a drive to cause reciprocation of said pistons; and (i) exhaust and inlet valves in the housings adjacent each of said chambers.

2. The fluid compressor of claim 1 wherein the cylinder housings are oppositely positioned.

3. The fluid compressor of claim 1 wherein the cylinder housings are positioned adjacent one another.

4. The fluid compressor of claim 1, wherein the exhaust and inlet valves comprise cartridge valves received in valve housings on a sidewall of each cylinder housing.

5. The compressor of claim 4, wherein each cartridge valve has a sleeve with valving assemblies at opposite ends thereof.

6. The compressor of claim 1, wherein the exhaust and inlet valves are reed type valves.

7. The compressor of claim 1, wherein the exhaust and inlet valves are rotary valves.

8. The compressor of claim 1, wherein the first and second reciprocating pistons and the first and second connecting rods are made from a ceramic material.

9. The compressor of claim 1, wherein each short leg has a passage through its length and each long leg has an aperture proximate to the curved cooperating recess, such that when the interlocking sections are inverted with respect to each other, the passage of each short leg is in alignment with the aperture of each long leg forming the bore holes.

* * * * *